US005078461A

United States Patent [19]

Beck et al.

[11] Patent Number: 5,078,461

[45] Date of Patent: Jan. 7, 1992

[54] CABINET WITH POCKETING DOORS

[75] Inventors: Robert L. Beck, Zeeland; Michael L. DePree, Hamilton; Andrew J. Kurrasch, Saugatuck, all of Mich.

[73] Assignee: Herman Miller, Inc., Zeeland, Mich.

[21] Appl. No.: 533,367

[22] Filed: Jun. 5, 1990

Related U.S. Application Data

[63] Continuation-in-part of Ser. No. 342,957, Apr. 25, 1989, Pat. No. 4,976,502.

[51] Int. Cl.[5] ..... A47B 88/00

[52] U.S. Cl. ..... 312/331; 49/254

[58] Field of Search ..... 49/254; 312/322, 323, 312/331, 107

[56] References Cited

U.S. PATENT DOCUMENTS

| | | | |
|---|---|---|---|
| 669,907 | 3/1901 | Wernicke et al. . | |
| 865,114 | 9/1907 | Mapes . | |
| 905,137 | 12/1908 | Benjamin . | |
| 974,542 | 11/1910 | Vanderveld . | |
| 1,055,064 | 3/1913 | Miller . | |
| 1,115,820 | 11/1914 | Hofman . | |
| 1,472,457 | 11/1922 | Brown . | |
| 1,532,893 | 4/1925 | East | 49/254 |
| 1,758,550 | 5/1930 | Wolters . | |
| 1,873,247 | 8/1932 | Abbott et al. . | |
| 1,922,487 | 8/1933 | Mellink . | |
| 2,598,255 | 5/1952 | Henkel . | |
| 2,652,305 | 9/1953 | Swedman et al. . | |
| 2,667,400 | 1/1954 | Wotring . | |
| 2,723,177 | 11/1955 | Belew . | |
| 2,936,206 | 5/1960 | Wilmer et al. . | |
| 3,017,233 | 1/1962 | Gates . | |
| 3,544,186 | 4/1968 | Björge . | |
| 3,687,505 | 8/1972 | Fall et al. . | |
| 3,722,964 | 3/1973 | Chitester et al. . | |
| 4,729,612 | 3/1988 | Stone . | |
| 4,815,797 | 3/1989 | Haab et al. . | |
| 4,852,212 | 8/1989 | Amann | 312/322 |
| 4,910,916 | 3/1990 | DuBach et al. | 312/322 |
| 4,974,912 | 12/1990 | Rask | 312/322 |

FOREIGN PATENT DOCUMENTS

| | | | |
|---|---|---|---|
| 1143415 | 2/1963 | Fed. Rep. of Germany . | |
| 1214990 | 11/1959 | France | 312/323 |

*Primary Examiner*—Kenneth J. Dorner
*Assistant Examiner*—Gerald A. Anderson
*Attorney, Agent, or Firm*—Varnum, Riddering, Schmidt & Howlett

[57] ABSTRACT

A cabinet comprising a plurality of walls including a side wall, the walls being joined together to provide a cabinet framework having an open front and an open interior. A door is mounted to the cabinet framework and is movable between a closed position in which the door at least partially covers the open front of the framework and a pocketed position in which the door is received within the open interior of the framework and adjacent to the side wall. The foor is mounted to upper and lower guide frames which are mounted to the cabinet framework adjacent to the side wall. Upper and lower ends of a carrier are slidably mounted to the upper and lower guide frames and the door is pivotally mounted to the carrier. A pair of upper wheels is mounted to the upper end of the carrier and in rolling contact with the upper guide frame. A pair of lower wheels is mounted to the lower end of the carrier and in rolling contact with the lower guide frame. One of the pair of upper wheels and one of the pair of lower wheels are load bearing. The carrier and the door reciprocate along the upper and lower guide frames as the door is moved between the open and pocketed positions.

50 Claims, 16 Drawing Sheets

CABINET WITH POCKETING DOORS

CROSS-REFERENCE TO RELATED APPLICATIONS

This application is a continuation-in-part of application Ser. No. 342,957, filed Apr. 25, 1989, now U.S. Pat. No. 4,976,502.

BACKGROUND OF THE INVENTION

1. Field of the Invention

The invention relates to cabinets and in particular cabinets having assemblies for mounting doors of the cabinets in such a manner that the doors can be swung opened and subsequently moved rearwardly or pocketed into the cabinet proper.

2. Description of the Prior Art

Generally, cabinets for use in office and other environments have doors for closing off open fronts of the cabinets. Typically, a door is hinged at one of its sides adjacent a side wall of the cabinet, swings toward a worker opening it and can be subsequently pushed laterally to secure work space in front of the cabinet for movement of articles in and out of the cabinet. However, in such position, the door may interfere with other work being performed in the work environment. In addition, in crowded work environments, the extent to which the door can be opened may be limited, thus restricting work space in front of the cabinet.

To eliminate the above-identified problems associated with cabinets having conventional hinged doors, some of today's cabinets are designed with pocketing assemblies, permitting rearward movement of the open-out doors into the cabinet adjacent to the cabinet side walls. In the stored or pocketed position, the doors do not interfere with work being performed in and around the cabinet. Cabinets with pocketing doors are disclosed in U.S. Pat. No. 4,729,612, to Stone, issued Mar. 8, 1988; Wilmer et al. U.S. Pat. No. 2,936,206, issued May 10, 1960; Iimura et al. U.S. Pat. No. 4,641,896, issued Feb. 10, 1987; and Nyquist U.S. Pat. No. 3,456,995, issued July 22, 1969.

For example, Wilmer et al. disclose a cabinet with pocketing doors and comprising a vertical carrier hingeably connecting a door and slidably mounted to upper and lower rails mounted to the cabinet side wall. After the door has been placed in the open position, it can be moved rearwardly with the carrier into the cabinet.

Nyquist also discloses a cabinet having pocketing doors, wherein a scissor mechanism is mounted to and between the cabinet back wall and a rear edge of the door. A rod at the rear edge of the door is rotatably and slidably received in opposing channels within top and bottom walls of the cabinet to permit the door to pivot in opening and closing, and to guide the door when the door is moved in and out of the cabinet.

A common problem associated with cabinets having pocketing doors is that the doors have a tendency to jam as a result of tilting or rotation in a vertical plane during movement. As a result, resistance is sometimes experienced when opening and closing the door, and when pocketing and unpocketing the door. Thus, the door and the fittings therefor can be damaged.

To remedy this problem, it has been found desirable to stabilize the pocketing doors to prevent jamming and binding. Such stabilizing means are known. For example, the U.S. patent to Stone, identified above, discloses a pocketing door pivotally and slidably mounted to upper and lower tracks by slide members secured to the doors, the tracks being mounted to the cabinet side wall. A pair of pulleys are mounted below the rear portion of the upper track and above the front portion of the lower track. A cable is threaded around the pulleys and has first and second ends attached to the slide members. The arrangement is said to prevent relative movement between the upper and lower slide members to prevent the door from jamming when moved in and out of the cabinet.

The U.S. patent to Iimura et al. also provides a stabilizing means for a pocketing door. A pair of rotatable pinions are mounted on upper and lower corners of the door and engage racks on the cabinet side wall so that the door can be pocketed within the cabinet without jamming. The rack and pinion mechanism assures that the upper and lower corners of the door are inserted or withdrawn from the rack at the same rate.

Further, Wilmer et al. disclose a cabinet having pocketing doors and means for preventing undesired movement of the door. Specifically, the upper and lower rails have flanges extending along the full length of the rails. For each flange, a pair of upper and lower brackets are mounted on the carrier in spaced relationship, thereby forming a slot receiving the respective rail flange. In this manner, when the carrier is moved along the rails, the pairs of brackets embrace the rail flanges to prevent excessive rocking movement of the carrier and thus the door mounted thereto.

For those cabinets with door pocketing assemblies wherein tracks or rails are used to guide the doors into the cabinets, it has been found desirable to align the open-out doors with the tracks for subsequent insertion into the cabinets.

It has also been found desirable to provide a pocketing door with a handle rotatably mounted to the door so that a user can grasp the handle to open the door and then pocket the door while maintaining the orientation of the handle toward himself/herself for convenient and easy operation of the door.

SUMMARY OF THE INVENTION

According to the invention, a cabinet has a plurality of walls including at least one side wall, the walls being joined together to provide a cabinet framework having an open front and an open interior. The door has a size to at least partially cover the open front of the cabinet. Means mount the door to the cabinet framework for movement between a closed position in which the door at least partially covers the open front and a pocketed position in which the door is received within the open interior of the framework and adjacent to the at least one side wall. The door mounting means comprise an upper guide frame and a lower guide frame, each mounted to the cabinet framework adjacent to the at least one side wall, a carrier having an upper end and a lower end, means for slidably mounting the upper and lower ends of the carrier to, respectively, the upper and lower guide frames, and means for pivotably mounting the door to the carrier. The carrier mounting means comprise a pair of upper wheels and a pair of lower wheels. The upper pair of wheels are mounted adjacent to the upper end of the carrier for rolling contact with the upper guide frame. The pair of lower wheels are mounted adjacent to the lower end of the carrier for rolling contact with the lower guide frame. At least one pair of the upper and lower wheels are load-bearing so that the carrier and the door reciprocate along the upper and lower guide frames as the door is moved between the open and pocketed positions. The upper and lower guide frames include means for limiting the rearward movement of the door toward the fully pocketed position.

The upper guide frame preferably includes an upper edge and a lower edge opposite the upper edge and one of the pair of upper wheels rolls on upper edge and the other of the pair rolls on the lower edge. Preferably, one of the upper pair of wheels is load-bearing. Further, the lower guide frame includes an upper edge and a lower edge opposite the upper edge. One of the pair of lower wheels rolls on the upper edge and the other of the pair rolls on the lower edge.

The upper guide frame preferably has a web intermediate an elongated upper rail and an elongated lower rail opposite the upper rail with the rails being integral with the web and extending outwardly thereof. One of the pair of upper wheels rolls on the upper rail and the other of the pair rolls on the lower rail. Preferably, one of the upper pair of wheels is load-bearing.

In like manner, the lower guide frame has a web intermediate an upper rail and an elongated lower rail opposite the upper rail with the rails being integral with the web and extending outwardly thereof. One of the pair of lower wheels rolls on the upper rail and the other of the pair rolls on the lower rail. Preferably, the other of the lower pair of wheels is load-bearing.

Preferably, the wheels include first and second circumferential channels with one of the circumferential channels in rolling contact with the rails. A stabilizing cable is wound around at least two of the wheels in the second of the circumferential channels and fixed to the door mounting means to stabilize the door and prevent relative rotation or binding of the door with respect to the framework as the door moves from the closed position to the pocketed position. In one embodiment, the cable is under tension and a spring is provided for tensioning the cable. A cable tie-down assembly is provided for selectively and releasably retaining the cable at a desired tension.

Also, according to the invention, a handle is rotatably mounted to the door for movement between an orientation perpendicular to the face of the door for gripping when the door is a closed position and an orientation parallel to the face of the door and projecting from the second edge of the door when the door is in the pocketed position. As the door is moved between the closed and pocketed positions, the handle rotates to an orientation that is aligned with the direction in which the force to move the door is applied. Desirably, the handle includes a spring for selectively retaining the handle in the desired orientation.

In a preferred embodiment, the handle includes a pair of pins, each pin having an equal number of faces and the spring engages a face of each pin when the handle is in the different orientations.

BRIEF DESCRIPTION OF THE DRAWINGS

The invention will now be described with reference to the accompanying drawings in which.

DETAILED DESCRIPTION OF THE PREFERRED EMBODIMENTS

Figure 1:
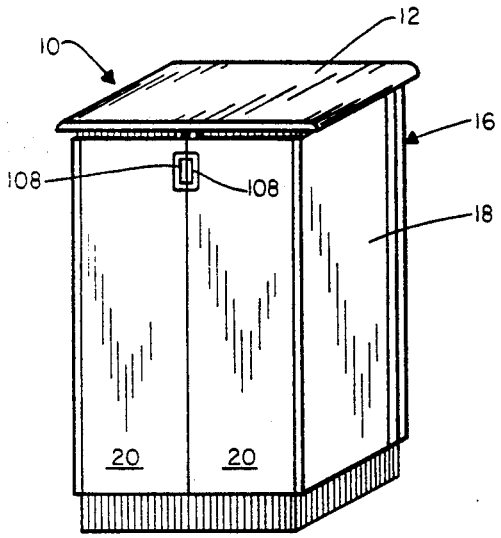
FIG. 1 is a perspective view of a cabinet which has pocketing doors and door handles according to the invention.
Figure 2:
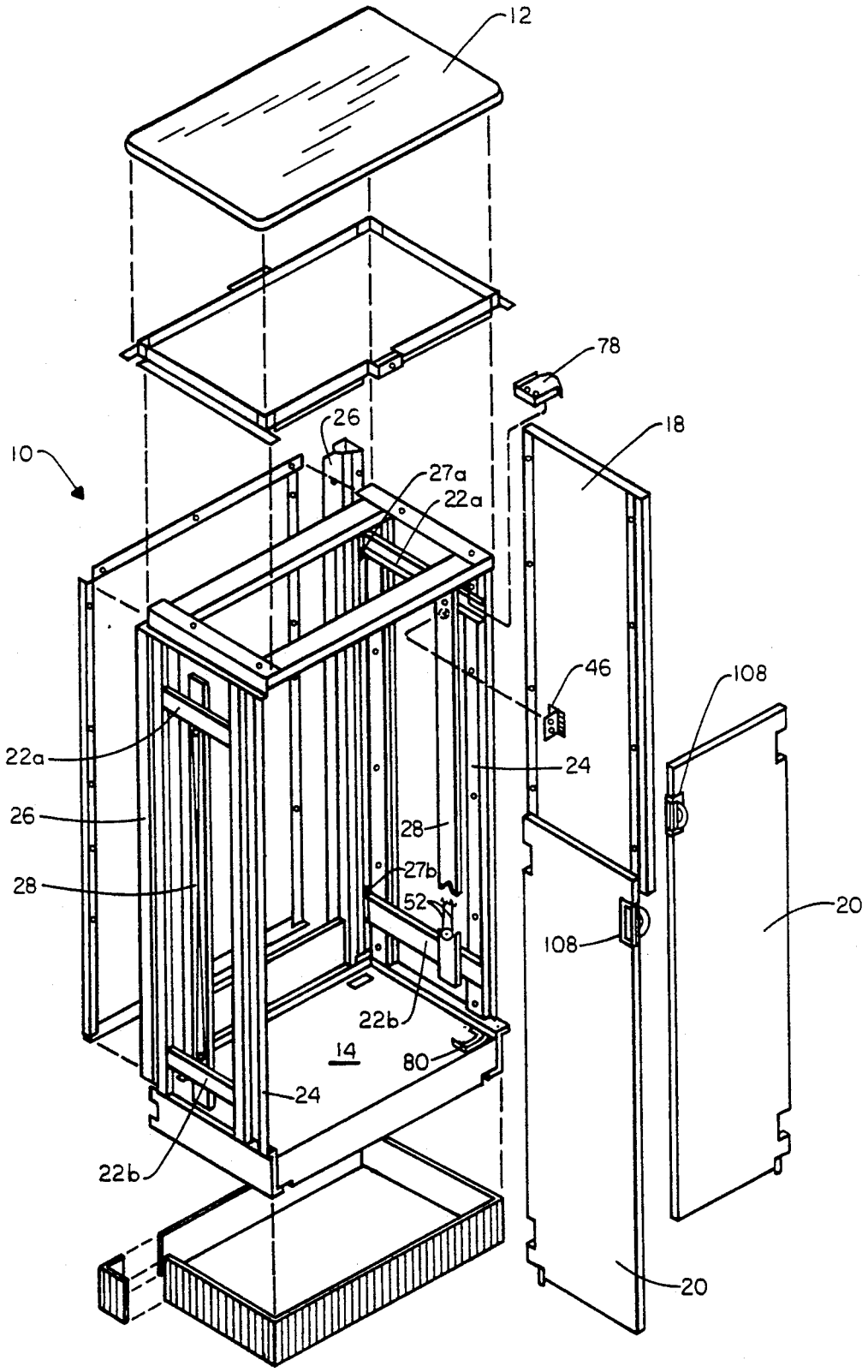
FIG. 2 is an exploded perspective view of framing of the type which may be used in a cabinet according to FIG. 1.

Referring to the drawings, and more particularly to FIGS. 1 and 2, the invention is shown in conjunction with a cabinet 10, having a top wall 12, a bottom wall 14, a back wall 16, a pair of side walls 18, and a pair of pocketing doors 20. Shown in FIG. 2 is a typical framework for a cabinet of the type shown in FIG. 1, it being understood that numerous variations may be made in the design of the framework without affecting the function and operation of the invention.

Figure 3:
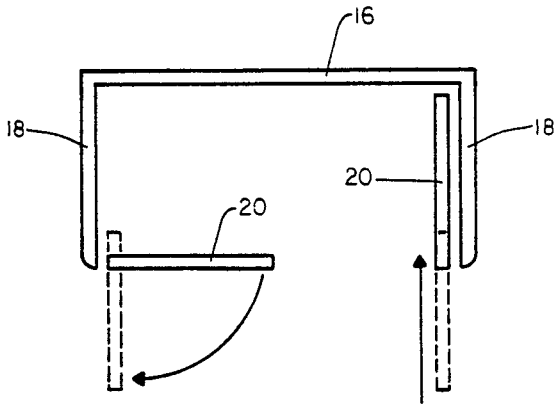
FIG. 3 is a plan view schematically showing the operation of the pocketing doors according to the invention and in conjunction with the cabinet of FIGS. 1 and 2.

Referring to FIG. 3, the cabinet incorporates the "pocketing" doors 20. That is, the doors 20, after being swung open, can be moved rearwardly to be stored within the cabinet adjacent the side walls 18 thereof. The arrows of FIG. 3 describe the direction of movement of the doors 20. Thus, the doors 20 can be moved between a closed position, as shown by the solid line representation for the left-hand door of FIG. 3, an open and partially pocketed position, as shown by the phantom lines for the left- and right-hand doors of FIG. 3, and an open and fully pocketed position, as shown by the solid line representation for the right-hand door of FIG. 3. The pocketing feature facilitates access to the cabinet while avoiding the hindrance of having to open and close the doors each time access to the cabinet is desired. In addition, the pocketing feature permits positioning of the doors out of interference with activities being performed in and around the cabinet. This feature is particularly helpful where the office environment provides limited space for admittance into the cabinet.

To accommodate the pocketing door feature of the cabinet, the cabinet is provided with a pocketing assembly hingeably and slidably connecting the doors to the cabinet proper. The assembly generally comprises mounting means for hingeably and slidably mounting the doors relative to the cabinet so that subsequent to opening the doors, the doors can be moved rearwardly into the cabinet. The assembly also comprises stabilizing means for resisting rotation of the doors in a vertical plane or tilting to ensure smooth operation of the doors without jamming. The assembly further comprises means for partially pocketing the door within the cabinet as the door is moved from the closed position to the open position. The assembly additionally comprises means for aligning the door relative to the cabinet side wall upon movement from the closed position to the open and partially pocketed position so the doors can be easily and smoothly moved rearwardly into the cabinet.

Figure 5:
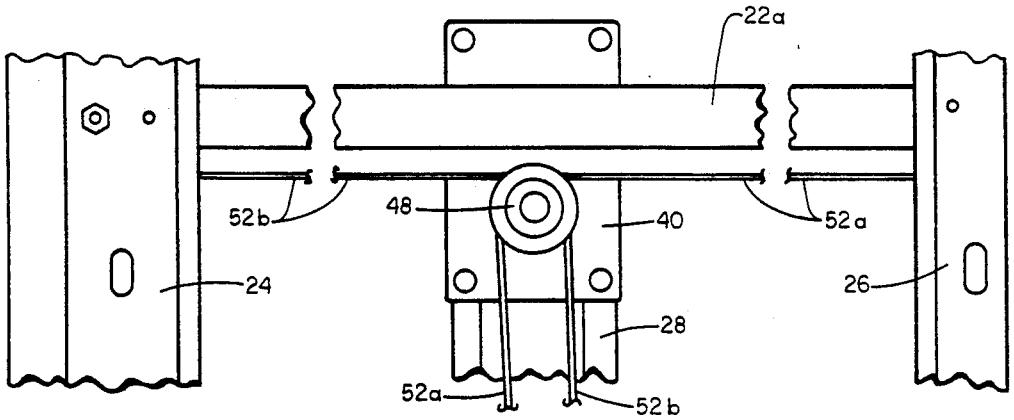
FIG. 5 is an enlarged elevational view of the area designated by the reference numeral A in FIG. 4.
Figure 6:
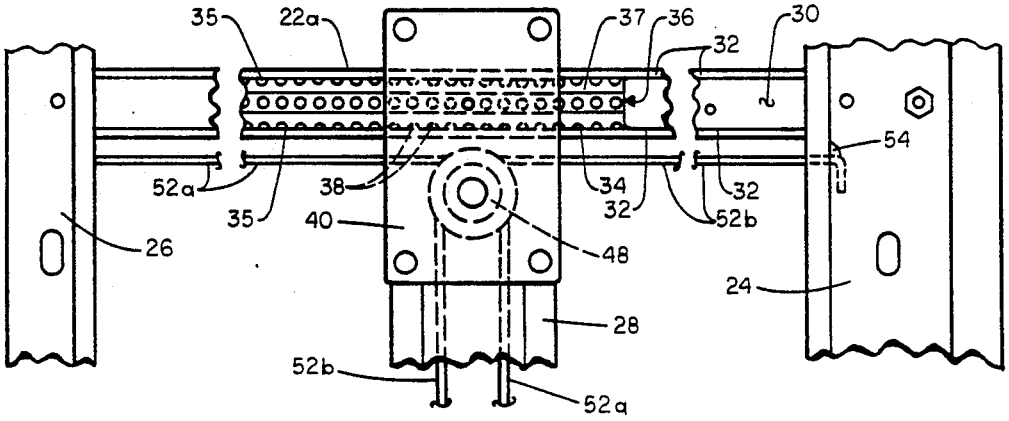
FIG. 6 is an enlarged elevational view similar to FIG. 5 but looking from a position interior of the cabinet and showing a vertical carrier bar and a ball cage according to the invention.
Figure 4:
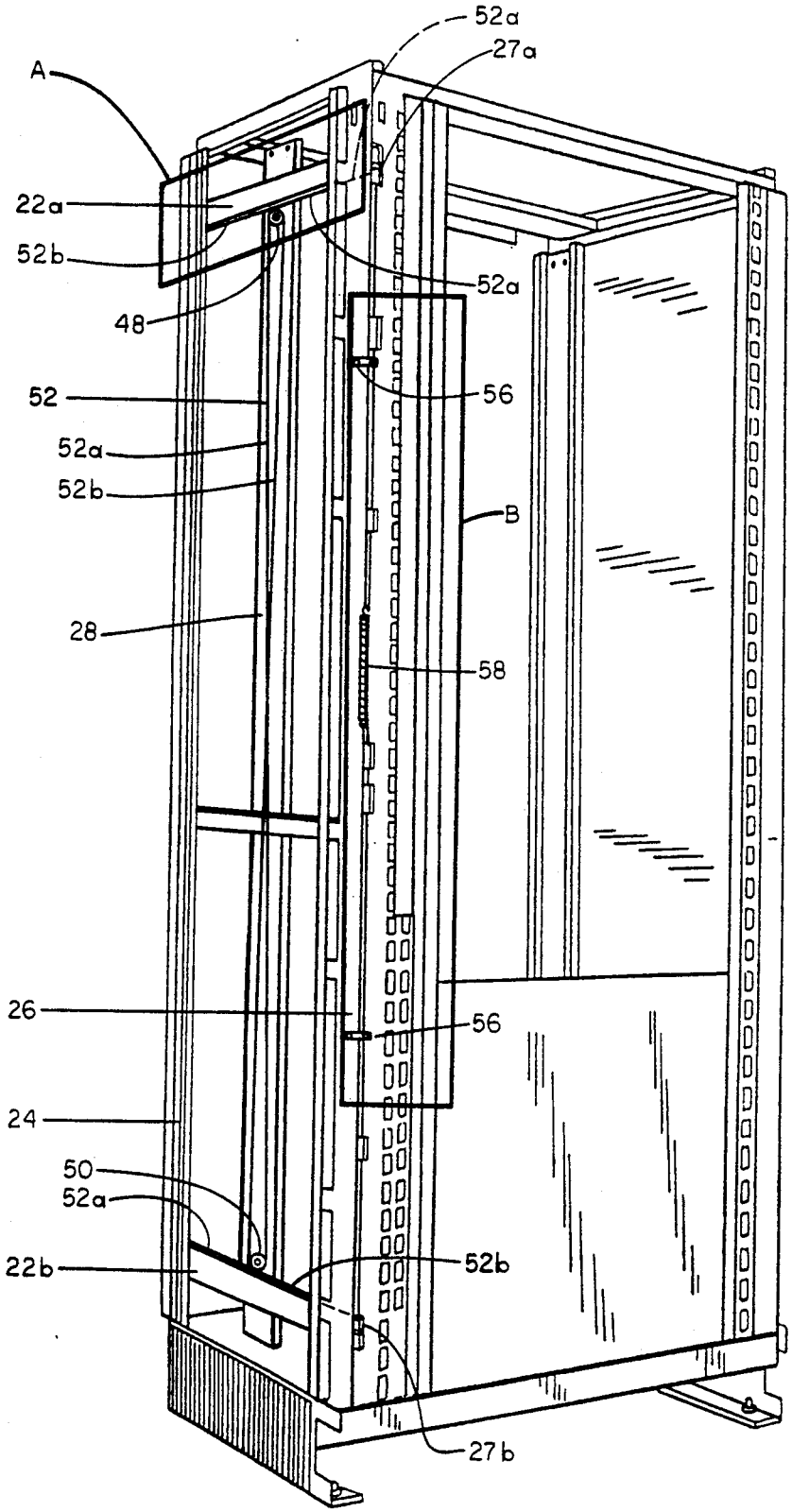
FIG. 4 is a perspective view of a partially assembled frame for the cabinet of FIG. 1–3 looking from a position exterior to the cabinet and showing the arrangement of the cable for the pocketing doors.

As illustrated in FIGS. 4 to 6, the means for slidably mounting the doors to the cabinet comprises, on each side of the cabinet, a pair of upper and lower horizontal guide frames 22*a*, 22*b* securely mounted to and between the cabinet front and rear vertical frame members 24, 26 at upper and lower ends and inside surfaces thereof. Holes 27*a*, 27*b* in the rear vertical frame members 26 function to receive rear ends of the guide frames 22*a*, 22*b* for mounting purposes. The mounting means further include a vertical carrier bar 28 slidably mounted to the upper and lower guide frames 22*a*, 22*b* for movement between front and rear ends of the guide frames.

The guide frames 22*a*, 22*b* each generally comprise an elongated rectangular channel-like member 30 formed with flanges 32 at upper and lower edges thereof. Slidably received for horizontal movement within the channel of each guide frame 22*a*, 22*b* between the upper and lower flanges is a ball slide 36. The ball slide 36 is a channel-like member formed with flanges 35 at upper and lower edges thereof. The flanges 35 are slightly contoured to create upper and lower tracks or races 34. Slidably received within the channel of the ball slide 36 is a ball cage 37. A plurality of ball bearings 38 associated with the ball cage 37 rest within the upper and lower races or tracks 34 for carrying the ball cage 37 back and forth between front and rear ends of the guide frame. An example of a satisfactory ball cage is manufactured by Accuride Inc., Santa Fe Springs, Calif. under the name Two Member Ball Bearing Slide. A slide plate 40 is secured to the ball cage 37 for sliding movement relative to the ball slide 36 and the guide frames 22*a*, 22*b*. The carrier bar 28 is securely mounted, as by spot welding, to the slide plate 40.

Figure 9:
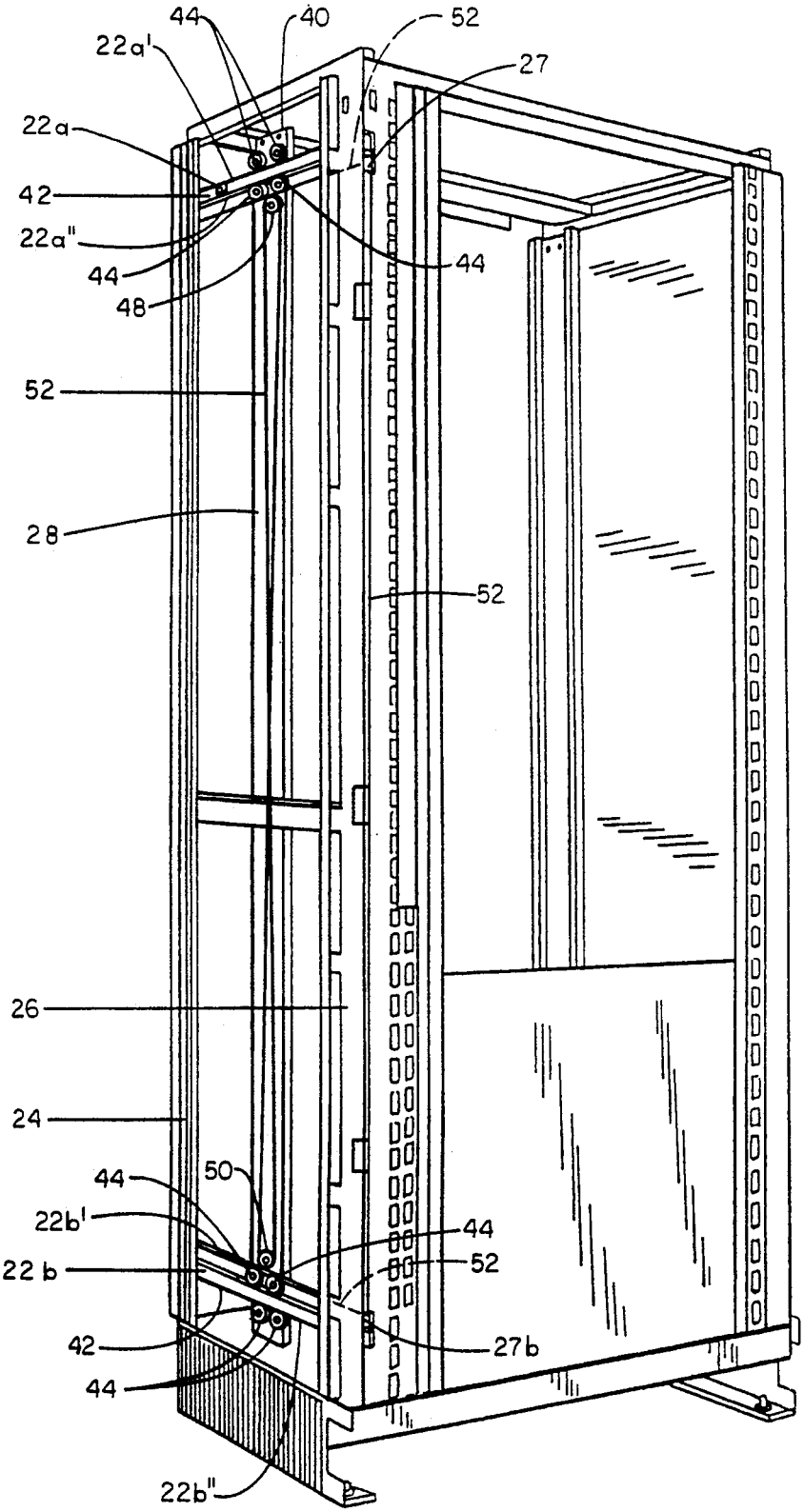
FIG. 9 is a perspective view similar to FIG. 4 but showing an alternative embodiment for the arrangement of the cable for the pocketing doors and showing alternative means for slidably mounting the doors to the cabinet.
Figure 10A:
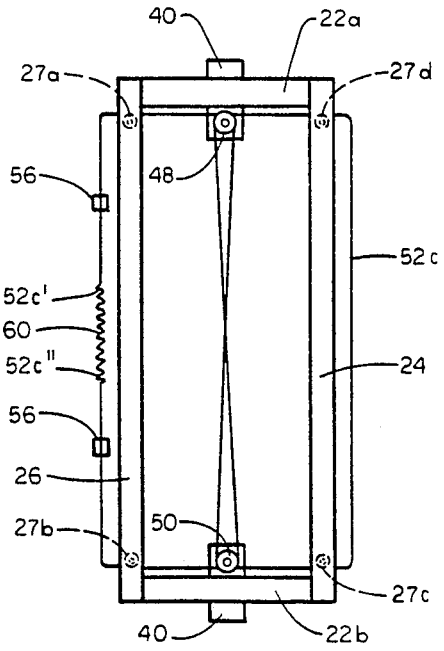
FIG. 10A is a schematic view of the arrangement of the cable of the embodiment of FIG. 10.
Figure 10:
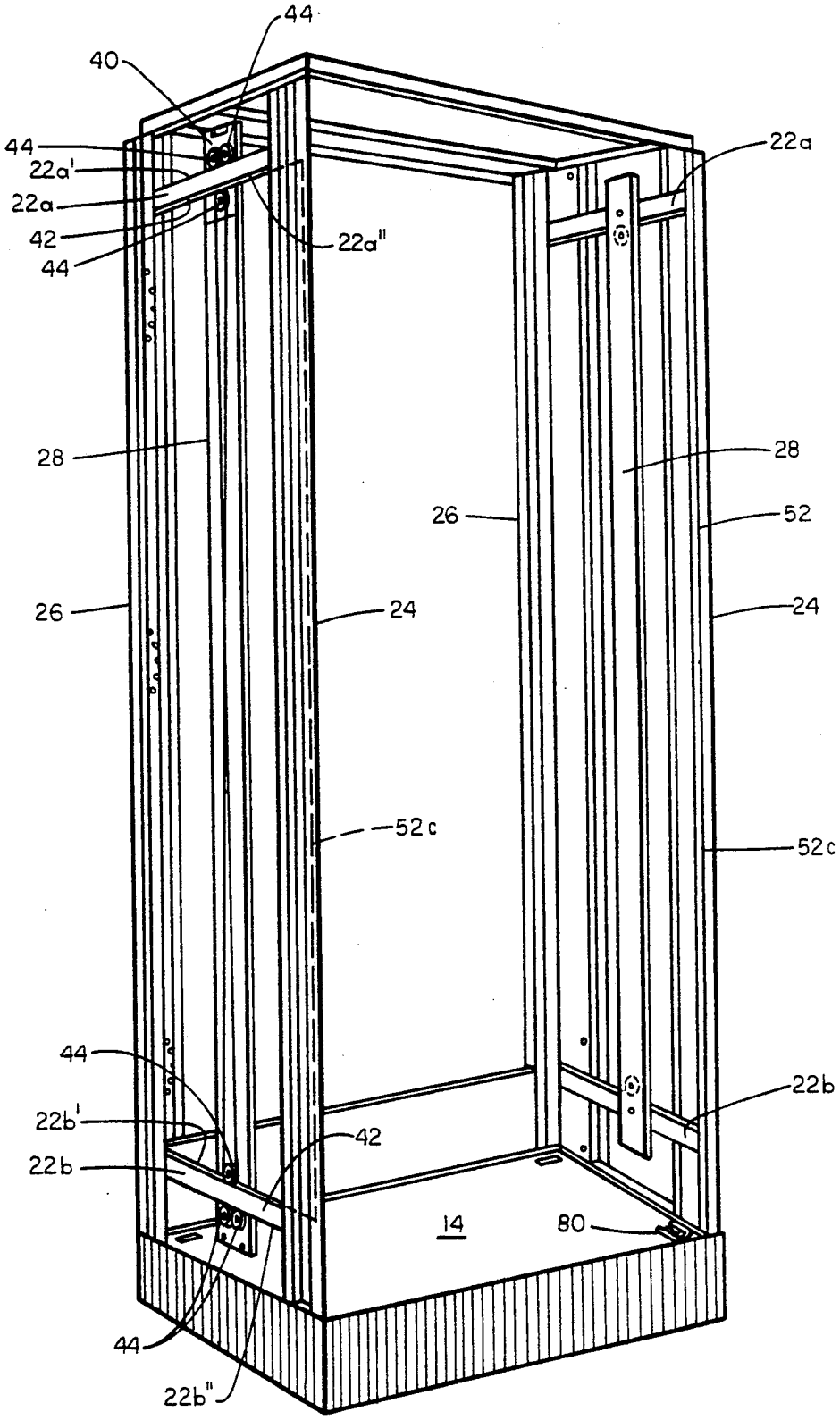
FIG. 10 is a perspective view similar to FIG. 4 but looking toward the front vertical frame member and showing a further embodiment for the arrangement of the cable for the pocketing doors and showing further alternative means for slidably mounting the doors to the cabinet.
Figure 11:
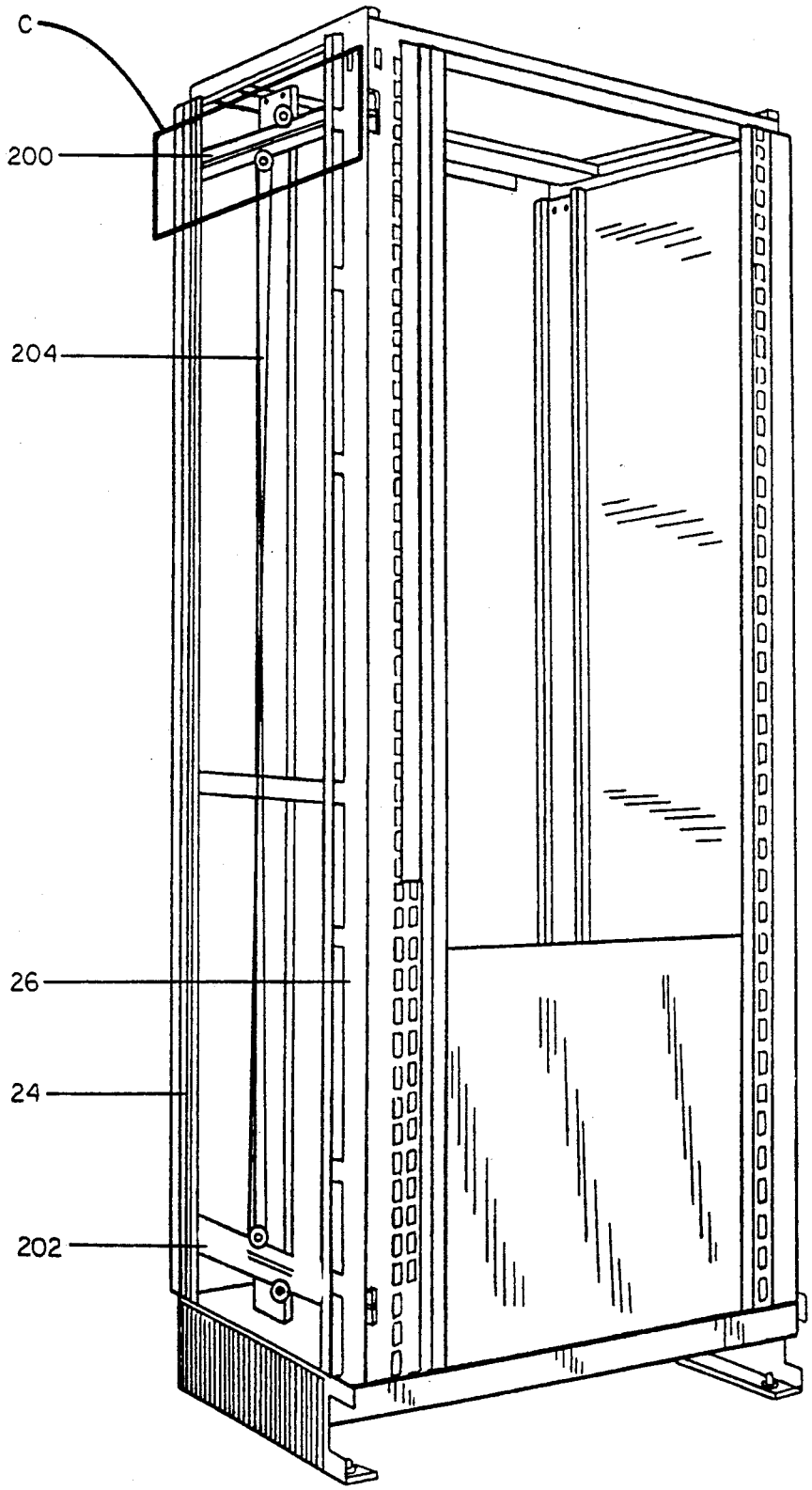
FIG. 11 is a perspective view of a fourth embodiment for the arrangement of the cable for the pocketing doors and showing a fourth embodiment for slidably mounting the doors to the cabinet.

An alternative embodiment of the mounting means is shown in FIGS. 9 and 10, wherein the guide frames 22*a*, 22*b* may each comprise a flat elongated, rectangular section of metal or plastic 42 which is secured to and between the front and rear vertical frame members 24, 26 at upper and lower ends and inside surfaces thereof. Holes 27*a*, 27*b* in the rear vertical frame members function to receive the rear ends of the guide frames 22*a*, 22*b* for mounting purposes. Several pulleys 44 are secured to the slide plate 40 and are arranged in a triangular or square pattern. A track associated with each pulley 44 rotatably and engagably receives an opposite longitudinal edge portion 22*a*', 22*a*'' and 22*b*', 22*b*'', respectively of the guide frames 22*a* and 22*b*, for sliding movement of the slide plate 40 and the carrier bar 28 relative to the guide frames 22*a*, 22*b*. In the embodiments of FIGS. 9 and 10, the ball cage 36 of FIG. 6 has been eliminated, the sliding movement of the slide plate 40 and the carrier bar 28 being provided by the mounting of the guide frames 22*a*, 22*b* between the pulleys 44.

Figure 16:
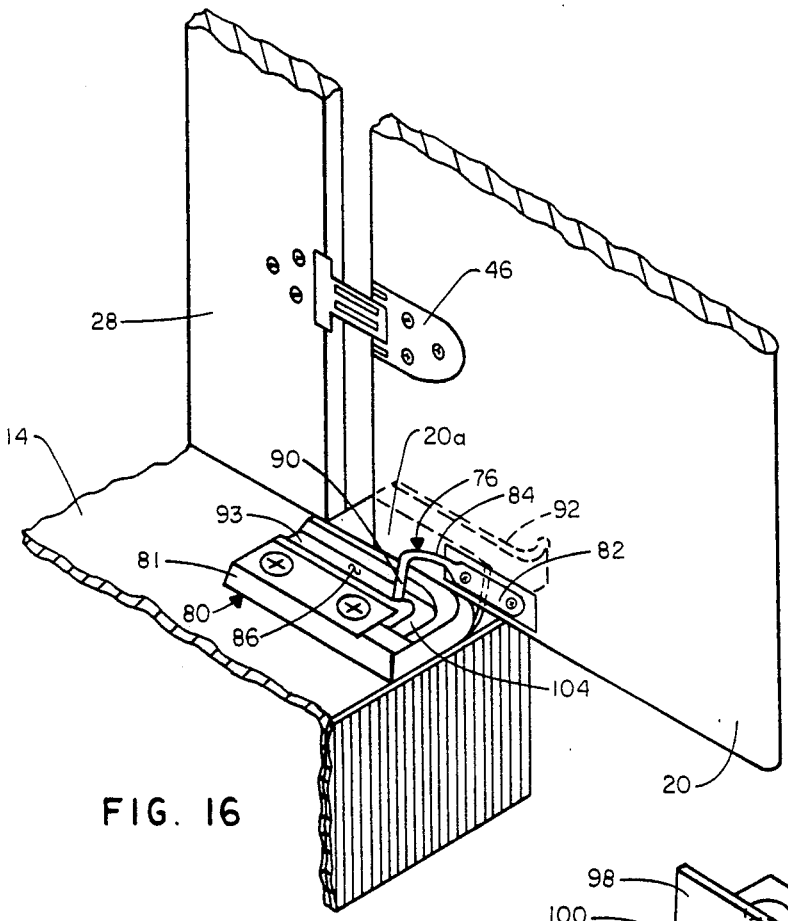
FIG. 16 is a fragmentary perspective of a lower guide bracket, a guide, a pocketing door, and a bottom wall of the cabinet of FIGS. 1 to 15 according to the invention.
Figure 16B:
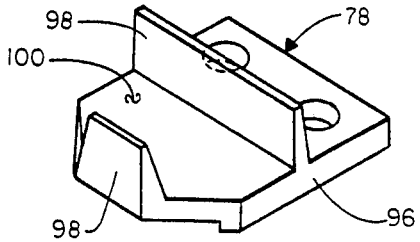
FIG. 16B is a perspective view of an upper guide bracket according to the invention.
Figure 16A:
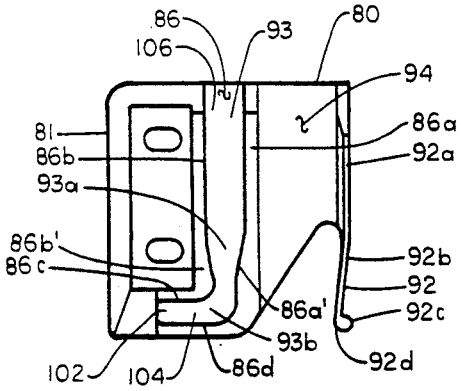
FIG. 16A is a plan view of the lower guide bracket.

As shown in FIGS. 2 and 16, the mounting means also comprises hinges 46 which mount each door 20 at upper and lower portions thereof to its respective carrier bar 28.

In this manner, each door 20 is movable along with the carrier bar 28 on the guide frames 22*a*, 22*b* between the partially pocketed and fully pocketed positions of the door as the carrier 28 is moved between the front and rear ends of the frames.

The stabilizing means is illustrated in FIGS. 4, 5, and 7 to 10 and functions, as stated above, to resist rotation or tilting of the doors in vertical planes to ensure smooth operation of the doors as they are moved between the partially pocketed and fully pocketed positions.

Figure 9A:
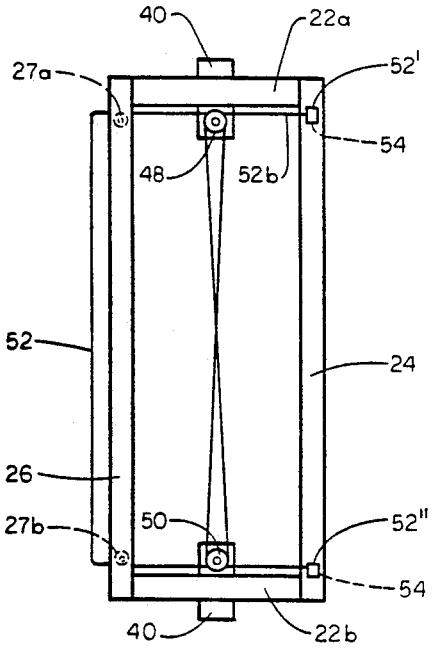
FIG. 9A is a schematic view of the arrangement of the cable of the alternative embodiment of FIG. 9.

As shown in FIGS. 9 and 9A, a first embodiment of the stabilizing means comprises, on each side of the cabinet, a pair of upper and lower pulleys 48, 50 mounted to outer sides of the carrier bar 28 adjacent the upper and lower ends thereof. The pulleys 48, 50 are positioned on the carrier bar 28 between the upper and lower guide frames 22*a*, 22*b* by mounting them to the slide plates 40. Each pulley includes two tracks for receiving a cable 52. First and second ends 52', 52'' of the cable 52 are securely fastened to lower and upper ends, respectively, of the front vertical frame member 24 with cable end clips 54.

Beginning from the lower pulley 50, a first end 52' of the cable 52 is wound clockwise (as viewed from the interior of the cabinet) around the lower pulley 50, whence it extends upwardly to be wound counterclockwise around the upper pulley 48. From here it extends rearwardly and through the hole 27*a* in the rear vertical frame member 26 below the upper guide frame 22*a* outside of the cabinet. It then extends downwardly along the rear vertical frame member 26 adjacent the back wall 16 until it is level with the lower pulley 50 where it reemerges into the cabinet through the hole 27*b* located in the rear vertical member 26 above the lower guide frame 22*b*. The cable 52 then extends forwardly and is wound counterclockwise around the second track of the lower pulley 50, and thence extends upwardly to be wound clockwise around the second track of the upper pulley 48. The second end 52'' of the cable 52 is attached to the front vertical frame member 24 below the upper guide frame 22*a* by the cable end clip 54. The tension exerted on the upper and lower portions of the door by the cable 52 tends toward equilibrium, thereby resisting rotational or tilting movement of the door in a vertical plane and thus resisting jamming of the door 20 as it is moved between the partially pocketed and fully pocketed positions.

Figure 7:
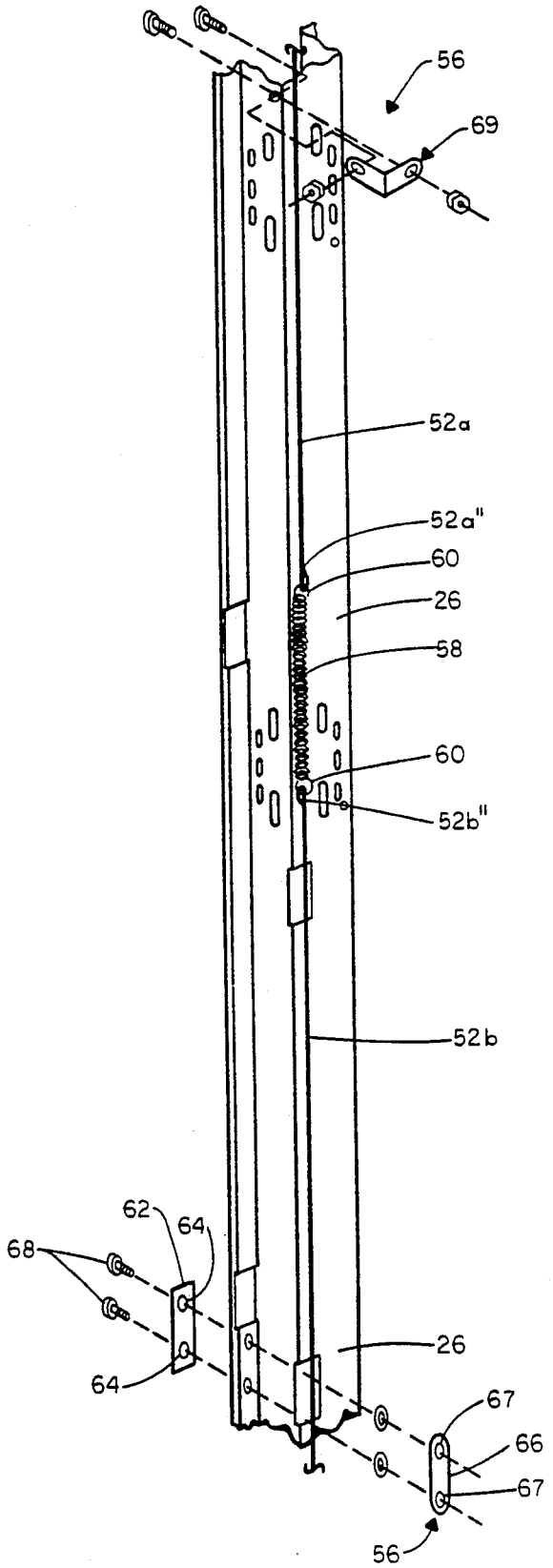
FIG. 7 is an enlarged exploded perspective view of the area designated by the reference numeral B in FIG. 4 and showing an extension spring and two embodiments of a cable tie down assembly used in the cabinet shown in FIGS. 1 to 4.
Figure 4A:
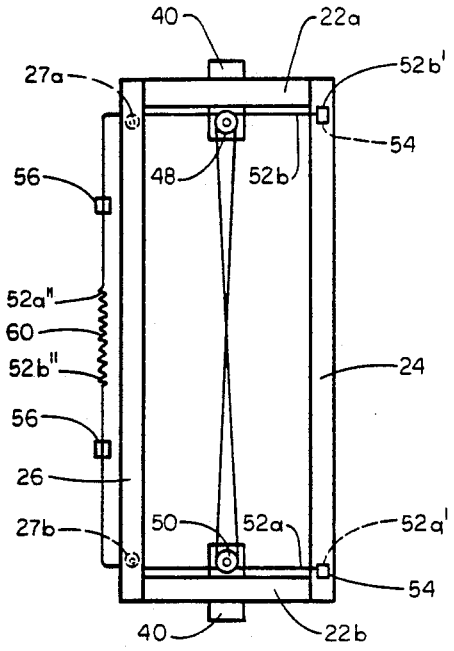
FIG. 4A is a schematic view of the arrangement of the cable of the embodiment of FIG. 4.
Figure 5A:
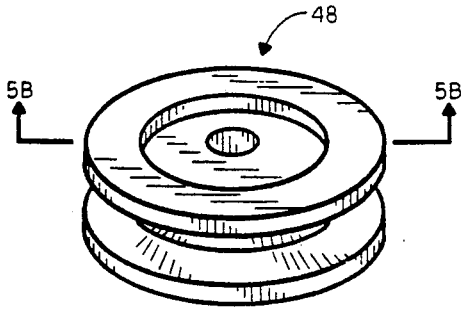
FIG. 5A is a perspective view of a two-track pulley used in the cabinet of FIGS. 1 to 4.
Figure 5B:
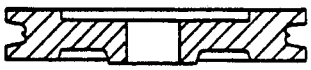
FIG. 5B is a sectional view of the two-track pulley of FIG. 5A taken along lines 5B—5B.

As shown in FIGS. 4, 4A and 7, which illustrate a second embodiment of the stabilizing means, a pair of upper and lower pulleys 48, 50, which are identical to the pulleys 48, 50 of the first embodiment of FIGS. 9 and 9A, are mounted to outer sides of the carrier bar 28 at the upper and lower ends thereof. The pulleys 48, 50 are mounted on the slide plates 40 which, in turn, are mounted on the carrier bar 28, the pulleys being disposed between the upper and lower guide frames 22*a*, 22*b*. Each pulley includes two tracks; each track receives one of two cables 52*a*, 52*b*.

A first end 52*a'* of the first cable 52*a* is securely fastened to a lower end of the front vertical frame member 24 with a cable end clip 54. The first cable 52*a* is then wound clockwise (as viewed from the interior of the cabinet) around the lower pulley 50, whence it extends upwardly to be wound counterclockwise around the upper pulley 48. From here it extends rearwardly along the upper guide frame 22*a* and through the hole 27*a* in the rear vertical frame member 26 below the upper guide frame 22*a* outside of the cabinet. It then extends downwardly along the rear vertical frame member 26 adjacent the back wall to a point approximately midway between the upper and lower guide frames 22*a*, 22*b* where the first cable 52*a* terminates, in a second end 52*a''*, the second end 52*a''* of the first cable 52*a''* having an eyeloop as shown clearly in FIG. 7. The first cable 52*a* is secured, against movement, to the rear vertical frame member by a cable tie down assembly 56 at a point several inches remote from its second end 52*a''*.

A first end 52*b'* of a second cable 52*b* is securely fastened to an upper end of the front vertical frame member 24 with the cable end clip 54. The second cable 52*b* is then wound counterclockwise (as viewed from the interior of the cabinet) around the second track of the upper pulley 48, and whence it extends downwardly to be wound clockwise around the second track of the lower pulley 50. From here it extends rearwardly along the lower guide frame 22*b* and through the hole 27*b* in the rear vertical member 26 above the lower guide frame 22*b*. It then extends upwardly along the rear vertical frame member 26 adjacent to the back wall where it terminates in a second end 52*b''* approximately midway between the lower and upper guide frames 22*a*, 22*b*. The second end 52*b''* of the second cable 52*b* is provided with an eyeloop. The second cable 52*b* is secured, against movement, to the rear vertical frame member 26 by a cable tie down assembly 56 several inches remote from the second cable's second end 52*b''*.

The second ends 52*a''*, 52*b''* of the first and second cables 52*a*, 52*b* are connected to opposite ends of an extension spring 58. The forces exerted on the upper and lower portions of the door by the cables tends toward equilibrium, thereby resisting rotational movement of the doors in a vertical plane and thus resisting jamming of the door as it is moved between the pocketed and unpocketed positions.

It can be seen that the second embodiment for arranging the cable differs from the first embodiment by interrupting the continuous run of cable adjacent to the rear vertical frame member 26 with the extension spring 58. Thus, two cables 52*a*, 52*b* instead of the single cable 52 are provided. Further, the cables 52*a*, 52*b* of the second embodiment are secured to the rear vertical frame member 26 by cable tie down assemblies 56.

The extension spring 58 in conjunction with the tie down assemblies enables the individual assembling the cabinet to properly tension the cables for smooth operation of the doors between the pocketed and unpocketed positions. The cables must be taut to ensure smooth operation of the doors. Similarly, the doors must be oriented such that their upper and lower horizontal edges are parallel with the upper and lower guide frames. Due to the forces exerted on the upper and lower portions of the door by the cables, an individual assembling the cabinet may adjust the vertical orientation of the doors by manipulating the cables and extension spring to exert the appropriate forces. Once the cables and extension spring have been manipulated to properly orient the doors, the cables are locked or clamped into place by the cable tie down assemblies, thus maintaining the appropriate cable tension and door orientation. If, after the initial installation, the doors should for some reason become out of alignment, they may be easily realigned by loosening the cable tie down assemblies and adjusting the tension of the cables to exert the proper forces on the upper and lower portions of the door.

The extension spring 58 is approximately $2\frac{3}{4}''$ in length and is formed of conventional music wire bent into a helical coil terminating at either end in substantially C-shaped hooks 60 for engaging the eyeloops for the second ends 52*a*'', 52*b*'' of the first and second cables 52*a*, 52*b*.

As shown in FIG. 7, the cable tie down assembly 56 comprises a rectangular plate 62 provided with a pair of spaced apertures 64 at each end, and a complementary shaped double nut 66 having threaded bores 67 aligned with the apertures. The plate 62 and nut 66 are mounted to opposite faces of the rear vertical frame member 26 by screws 68 in registry with the aligned apertures and bores 67. The cable is held in place by clamping it between the plate 62 and the rear vertical frame member 26, the cable diagonally cutting across the face of the plate between the apertures. Alternatively, as is also shown in FIG. 7, the cable tie down assembly 56 may be in the form of an L-shaped clamp 69 mounted on the rear vertical frame member 26 to secure the cable between itself and the rear vertical frame member.

Figure 8:
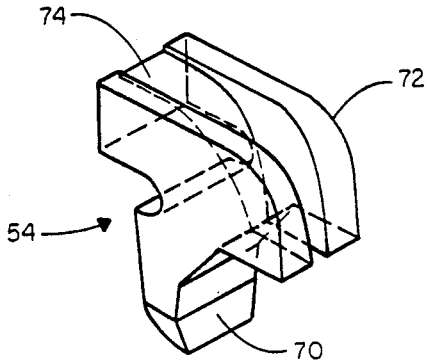
FIG. 8 is an enlarged perspective view of a cable end clip according to the invention.

As shown in FIG. 8, each cable end clip 54 comprises a leg 70 which is received in an aperture in the front vertical frame members 24. Each end clip further comprises a shoulder portion 72 having arcuate track 74 in which the cable is tightly received. First ends 52*a*', 52*b*' of the cable may have crimp fittings to further secure the cable to the end clips 54. The crimp fittings bear against the shoulder portion 72 adjacent a narrowed portion of the track 74 to prevent sliding movement of the cables relative the end clips.

A third embodiment for the stabilizing means is shown in FIGS. 10 and 10A and comprises a pair of upper and lower pulleys 48 and 50, which are identical to the pulleys 48 and 50 of the first and second embodiments of the stabilizing means, mounted to outer sides of the carrier bar 28 at the upper and lower ends thereof. The pulleys 48, 50 are mounted on the slide plates 40, which in turn are mounted on the carrier bar 28, the pulleys being disposed between the upper and lower guide frames 22*a*, 22*b*. Each pulley includes two tracks for receiving a cable 52*c*.

A first end 52*c*' of the cable 52*c* is formed with an eyeloop which engages a C-hook 60 on one end of an extension spring 58, the spring 58 being identical to the spring 58 of the second embodiment. From the first end 52*c*' of the cable 52*c*, the cable extends vertically along the rear vertical frame member where it is routed through a hole 27*a* in the same and below the upper guide frame 22*a*. The cable 52*c* then extends parallel to and below the guide frame 22*a* to be wound in a clockwise direction (as viewed from inside the cabinet) about the upper pulley 48. The cable then extends downward to be wound in a counterclockwise direction about the lower pulley 50 from whence it extends forwardly along the lower guide frame 22*b* and through a hole 27*c* in the front vertical frame member 24. The cable is routed parallel to the front vertical frame member 24, and then backward through a hole 27*d* in the front vertical frame member below the upper guide frame 22*a*. The cable extends rearwardly along the upper guide frame 22*a* to be wound counterclockwise about the upper pulley 48. The cable then descends to be wound clockwise about the lower pulley 50 from whence it extends rearwardly along the lower guide frame 22*b* and through a hole 27*b* in the rear vertical frame member 26. The cable then extends vertically along the rear vertical frame member 26, terminating in a second end 52*c*'' which is formed with an eyeloop. The eyeloop receives a C-hook 60 on the opposite end of the extension spring 58 from which the first end 52*c*' was received. The cable 52*c* is secured to the rear vertical frame member 26 at points several inches removed from its first and second ends 52*c*', 52*c*'' by cable tie down assemblies 56 which are identical to either of the two embodiments of the cable tie down assembles as shown in conjunction with the second embodiment of the stabilizing means of FIGS. 4, 4A and 7. Thus, it can be seen that the third embodiment of the stabilizing means of FIGS. 10 and 10A combines the advantages of the single cable of the first embodiment of FIG. 9 and 9A with the advantages of the cable tie down assemblies and the extension spring of the second embodiment of FIGS. 4 and 4A. The cable end clips 54 are not an aspect of the third embodiment.

A fourth embodiment for the cable and for slidably mounting the doors 20 to the cabinet 10 is illustrated in FIGS. 11 to 15. The cabinet 10 shown in FIGS. 11 to 15 includes upper and lower horizontal guide frames 200, 202, respectively, and a vertical carrier bar 204 that is substantially identical to the carrier bar 28 shown in FIGS. 1 to 10. The carrier bar 204 is slidably mounted at upper and lower ends thereof to, respectively, the upper and lower guide frames 200, 202. The guide frames 200, 202 are mounted to and between the front and rear vertical frame members 24, 26 of the cabinet 10.

The upper and lower horizontal guide frames 200, 202 are substantially similar in construction and have a generally U-shaped configuration that includes a web 206 that is integral with and extends between upper and lower radiused mounting rails or ears 208, 210, respectively. The carrier bar 204 is slidably mounted to the guide frames 200, 202 and is adapted for reciprocating movement between the front and rear vertical frame members 24, 26. The carrier bar 204 is slidably mounted to the upper and lower guide frames by a pair of upper wheels or roller mechanisms 212*a*, 212*b* and a pair of wheels or lower roller mechanisms 214*a*, 214*b*. Each wheel or roller mechanism is substantially identical and therefore will be described with particularity only with reference to the wheel or roller mechanism 212*a* shown in FIG. 15.

The roller mechanism 212*a* includes an inner sleeve 216 and an outer sleeve 218 with a cavity 220 formed therebetween. A plurality of low friction ball bearings 222 are received in the cavity 220 and rotatably mount the outer sleeve 218 to the inner sleeve 216. Centrally located, axial openings 224, 226 are provided in, respectively, the inner and outer sleeves 216, 218.

The outer sleeve 218 is provided with a first circumferential channel or rail engaging track 228 and a second circumferential cable receiving channel 230 adjacent to the first channel. The second channel 230 has a double track configuration that includes first and second cable receiving tracks 230*a*, 230*b*, respectively.

Figure 12:
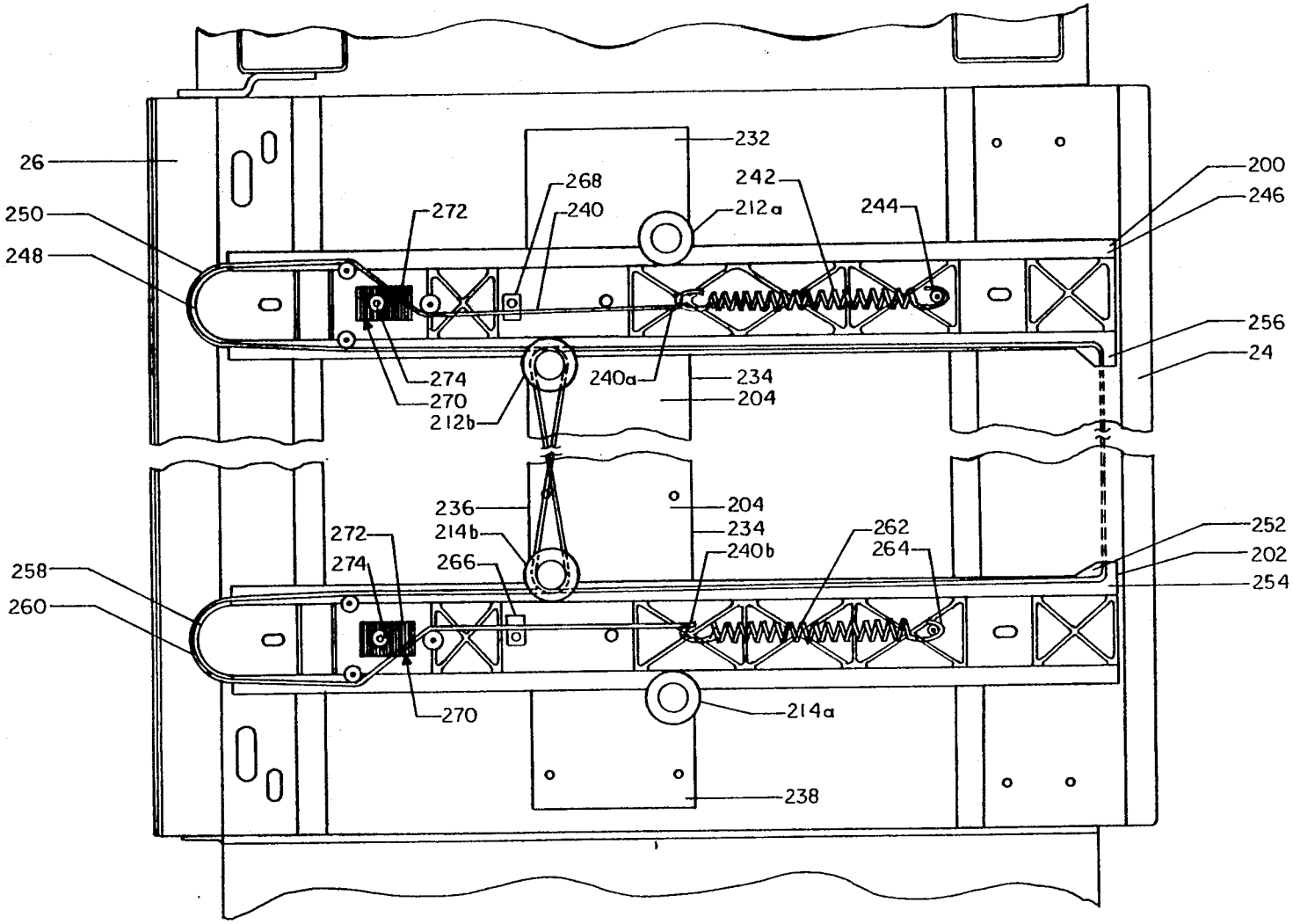
FIG. 12 is a schematic view of the arrangement of the cable of the fourth embodiment of FIG. 11.
Figure 13:
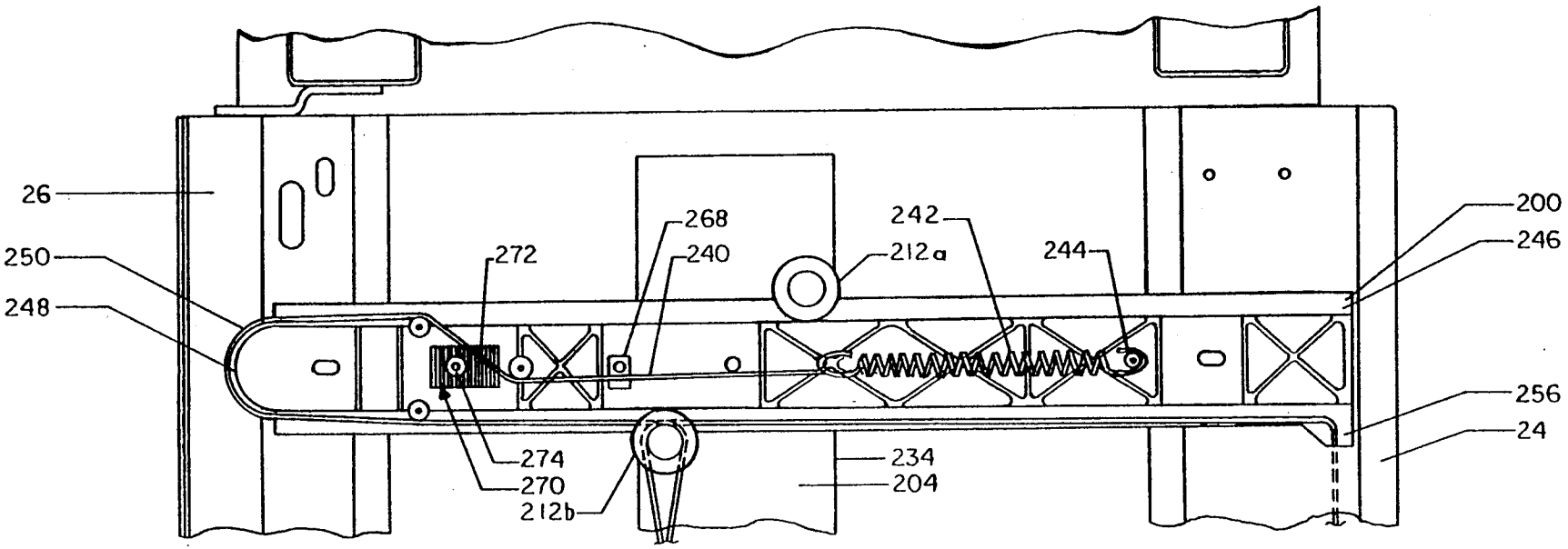
FIG. 13 is an enlarged, fragmentary elevational view of the area designated by the reference C in FIG. 11, but looking from an opposite side thereof.

In assembly and referring to FIG. 12, the upper roller mechanisms 212*a*, 212*b* are mounted to the vertical carrier bar 204 adjacent to an upper end 232 thereof with rivets or other fasteners. The fasteners are received in the central openings 224, 226 of the inner and outer sleeves 216, 218 such that the outer sleeve remains freely rotatable with respect to the vertical carrier bar 204 and the inner sleeve. The roller mechanism 212*a* is mounted adjacent to a side edge 234 of the carrier bar 204 while the roller mechanism 212*b* is mounted adjacent to an opposite side edge 236 of the carrier bar and vertically spaced below the roller mechanism 212*a* a distance substantially equal to the height of the upper horizontal guide frame 200. Similarly, the lower roller mechanisms 214*a*, 214*b* are rotatably mounted to the vertical carrier bar 204 adjacent to a lower end 238 thereof. The roller mechanism 214*a* is substantially aligned with the roller mechanism 212*a* and adjacent to the carrier bar side edge 234 whereas the roller mechanism 214*b* is aligned below the roller mechanism 212*b*, mounted adjacent to the carrier bar side edge 236, and vertically spaced above the mechanism 214*a* a distance substantially equal to the height of the lower horizontal guide frame 202.

Figure 14:
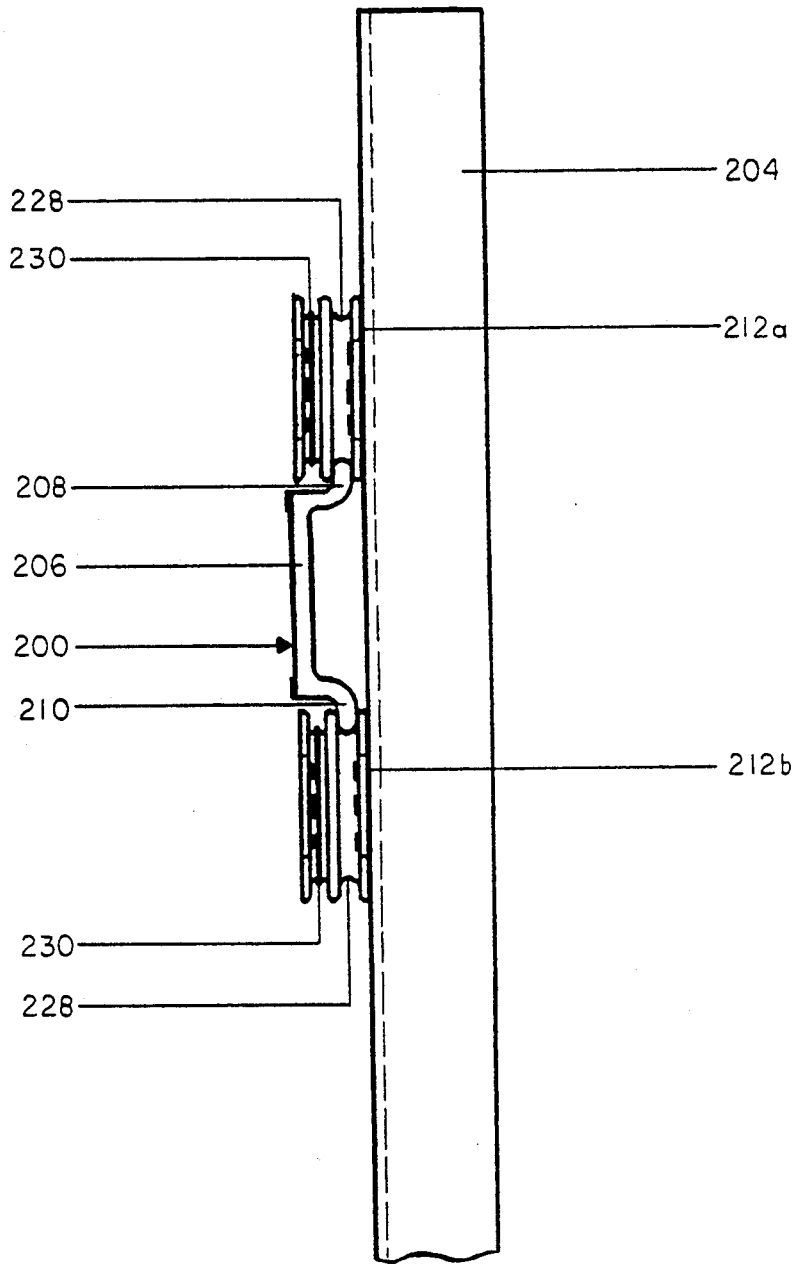
FIG. 14 is a sectional view taken along lines 14—14 of FIG. 13.
Figure 15:
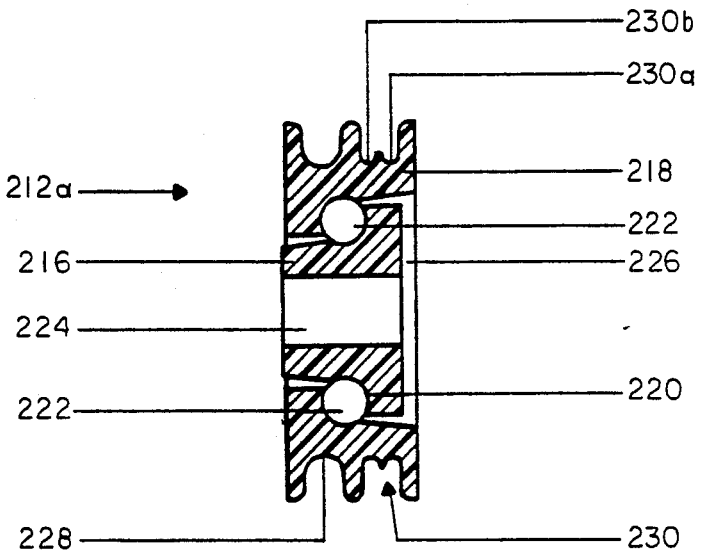
FIG. 15 is a sectional view of a pulley for the fourth embodiment for slidably mounting the doors to the cabinet.

As seen in FIG. 14, the vertical carrier bar 204 is mounted to the cabinet 10 such that the upper horizontal guide frame 200 is received between the spaced apart upper roller mechanism 212*a*, 212*b*. More particularly, the upper mounting ear 208 of the upper horizontal guide frame 200 is received within the first or rail engaging channel 228 of the roller mechanism 212*a* while the lower mounting ear 210 of the guide frame is received within the rail engaging channel 228 of the roller mechanism 212*b*. Similarly, the lower horizontal guide frame 202 is received between the pair of lower roller mechanisms 214*a*, 214*b*, the upper mounting ear 208 of the guide frame engaging the channel 228 of the roller mechanism 214*b* and the lower mounting ear 210 engaging the channel 228 of the roller mechanism 214*a*.

Thus, the vertical carrier bar 204 and the door 20 mounted thereto and carried thereby slidably reciprocate along the guide frames 200, 202 as the door is moved between the open and closed positions. It will be understood that the roller mechanisms 212*a*, 214*a* are load bearing and, because they are spaced apart a considerable vertical distance, all of the roller mechanisms 212*a*, 212*b*, 214*a*, 214*b* can be conveniently mounted to a carrier bar of relatively narrow width. In comparison to the embodiments illustrated in FIGS. 1 to 10 and described with particularity hereinabove, the embodiment of FIGS. 11 to 15 eliminates the need for the ball slide 36 which simplifies and reduces the cost of constructing the cabinet 10. In addition, ball slides can experience a phenomenon referred to as "slide creep" which affects the otherwise synchronized movement of the sliding elements of the ball slide which, in turn, hampers the otherwise smooth movement of the door as it is manipulated between the open and closed positions.

The embodiment of FIGS. 11 to 15 further includes a cable 240 similar to the cables described hereinabove. A first end 240*a* of the cable 240 is secured to an extension spring 242 an opposite end 244 of which is mounted to the upper horizontal guide frame 200 by a pin or the like. The spring end 242 is mounted adjacent to an end 246 of the upper horizontal guide frame that is secured to the front vertical frame member 24. The cable 240 extends from the spring 242 along the upper horizontal guide frame 200 and toward the rear vertical frame member 26. The cable 240 is received within an arcuate track 248 integrally formed in an end 250 of the upper horizontal guide frame 200, the track defining, in part, the rounded perimeter of the frame end. The cable 240 extends through the track and reverses direction to run along the upper horizontal guide frame 200 toward the front vertical frame member 24. The cable 240 is received in the first track 230*a* of the second channel 230 of the roller mechanism 212*b* and wraps around the roller mechanism 212*b* in counterclockwise direction (as viewed from inside the cabinet). The cable extends downwardly to be received within the first track 230*a* of the second channel 230 of the roller mechanism 214*b*. The cable 240 wraps around the roller mechanism 214*b* in a clockwise direction (as viewed from inside the cabinet). The cable 240 then extends along the lower horizontal guide frame 202 toward the front vertical frame member 24 where it passes through an opening 252 in an end 254 of the guide frame 202.

The cable then extends upwardly and parallel to the front vertical frame member 24, passes through an opening 256 in the end 246 of the upper horizontal guide frame 200 to travel along the lower guide frame.

The cable 240 is received in the second track 230*b* of the second channel 230 of the roller mechanism 212*b* and wraps around the same in a clockwise direction (as viewed from inside the cabinet). The cable then extends downwardly to the roller mechanism 214*b* where it is received in the second track 230*b* of the second channel 230 thereof. The cable 240 wraps around the roller mechanism 214*b* in a counterclockwise direction (as viewed from inside the cabinet) and extends along the lower horizontal guide frame 202 toward the rear vertical frame member 26 to be received with an arcuate track 258 at an end 260 of the guide frame. The track 258 is similar to the track 248 and, in part, defines the perimeter of the track end 260. The cable 240 then extends along the lower horizontal guide frame 202 toward the front vertical frame member 24 and terminates in a second end 240*b*. The cable end 240*b* is secured to an extension spring 262 similar to the spring 242. An opposite end 264 of the spring 262 is mounted to the lower horizontal guide frame by a pin or the like. The cable 240 is secured to the lower horizontal guide frame 202 adjacent the cable end 240 by a cable tie down assembly 266 in the form of a bolt and nut combination. Similarly, the cable 240 is secured to the upper horizontal guide frame 200 adjacent to the cable end 240*a* by a cable tie down assembly 268.

The springs 242 and 262 are similar to the extension spring 58 described hereinabove. The springs 242 and 262 in cooperation with the cable tie down assemblies 266, 268 enable an individual who is assembling the cabinet to properly tension the cables for smooth operation of the doors between the pocketed and unpocketed positions. Thus, as noted hereinabove, the vertical orientation of the doors can be manipulated by adjusting the cables and springs to exert the appropriate forces on the upper and lower portions of the door. Once the doors, cables, and springs have been so manipulated, the cables can be locked or clamped into place by the cable tie down assemblies thus maintaining the appropriate cable tension and door orientation.

The upper and lower guide frames 200, 202, respectively, each include a door stop 270 mounted adjacent to, respectively, the frame ends 250, 260. The position of the door stop 270 on the guide frame is adjustable relative to the end thereof. Each stop 270 includes a flat plate 272, an upstanding boss 274, and means for mounting the stop to the guide frame such as a screw or other appropriate mechanical fastener. The preferred position of the stop 270 relative to the frame end is determined by the width of the door 20, as explained more fully hereinbelow.

In operation of the stabilizing means, as a door 20 is moved from the partially pocketed to the fully pocketed position, the upper and lower pulleys (or wheels) roll over their respective cables, the cables being fixed and immovable. As the door travels toward the rear ends of the upper and lower guide frames, the cable length between the front vertical frame member and the pulleys "grows" or increases. Correspondingly, the length of cable between the pulleys and the rear vertical frame member "shrinks" or decreases, the amount of cable shrink being equal to the amount of cable growth. Upon moving the door to the partially pocketed position from the fully pocketed position, the reverse of the above occurs.

As stated above, the pocketing assembly further comprises means for partially pocketing the doors 20 relative to the cabinet. To this end, referring to FIGS. 16–17C, the pocketing assembly comprises a guide 76 and upper and lower guide brackets 78, 80. The guide 76 comprises a flat mounting section 82 and an L-shaped guide stud 84 one leg of which is formed integral with the mounting section 82 and offset therefrom at a 45° angle. The mounting section 82 secures the guide 76 to the door 20 at a lower inside edge thereof adjacent to but offset from an outer corner 20*a*, said corner being adjacent to the cabinet side wall 18 when the door 20 is closed. The guide 76 is formed from hardened carbon steel wire in a two step die process. In the first step, the wire is bent to form the L-shape guide stud 84. In the second step, a portion of the steel wire is flattened and punched to provide the mounting section 82.

The lower guide bracket 80 comprises a molded plastic member having an L-shaped track 86 formed therein. The track 86 has a long leg 93 and a short leg 104 which are defined by track walls 86*a*, 86*b*, 86*c*, 86*d* molded integral with the lower guide bracket 80. The short leg 104 of the track 86 is of uniform width but generally narrower than the width of the long leg 93. The long leg 93 is similarly of uniform width except in a transition region 93*a* where the width of the track narrows to approximate that of the short leg 104. In the transition region 93*a*, the track walls 86*a* and 86*b* are provided with complementary, inwardly directed beveled surfaces 86*a'* and 86*b'*. The lower guide bracket 80 is secured by conventional mounting hardware to the front edge of the bottom wall 14 of the cabinet adjacent a front corner formed by the bottom wall 14 and the side wall 18. When properly positioned, a distal end 90 of the guide stud 84 is received by the L-shaped track 86 of the lower guide bracket 80.

The lower guide bracket 80 further includes a spring arm 92 formed integral therewith and substantially parallel to the track wall 86*a*, thus defining a channel 94 between the spring arm 92 and the track wall 86*a*. The spring arm 92 is formed with a relatively stiff portion 92*a* that is integral with a base 81 of the lower guide bracket 80 and a resilient portion 92*b* that is continuous with the relatively stiff portion 92*a*. The resilient portion 92*b* is angled inwardly slightly toward the track wall 86*a*. A distal end of the resilient portion 92*b* is formed with a contoured lobe 92*c* that provides a camming surface 92*d*. The width of the channel 94 between the stiff portion 92*a* of the spring arm 92 and the track wall 86*a* is slightly greater than the thickness of the pocketing door 20. The width of the channel 94 between the resilient portion 92*b* of the spring arm and the track wall 86*a* is slightly less than the thickness of the pocketing door 20.

Figure 16C:
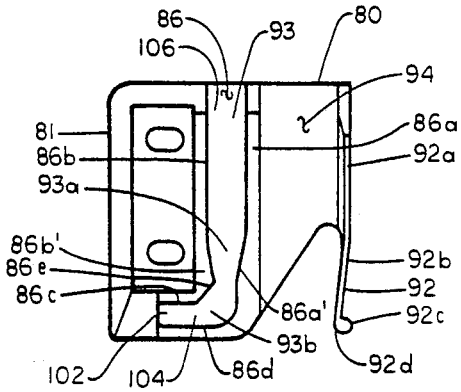
FIG. 16C is a plan view of a second embodiment of the lower guide bracket.
Figure 17:
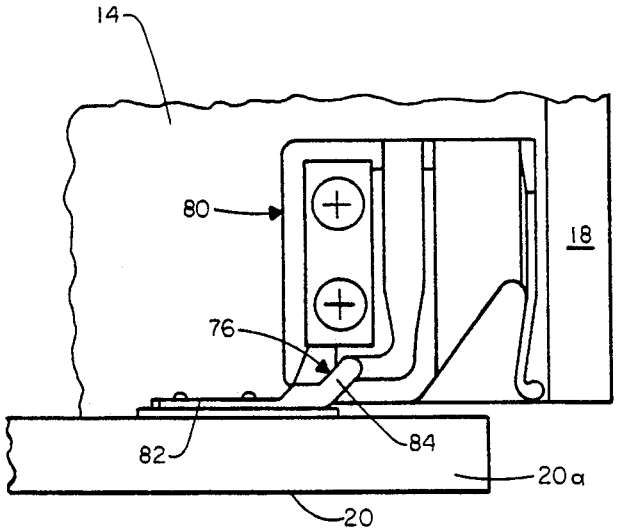
FIG. 17 is a fragmentary plan view showing the pocketing door and the lower guide bracket according to the invention of FIGS. 1 to 17B, with the pocketing door in a fully closed position.
Figure 17A:
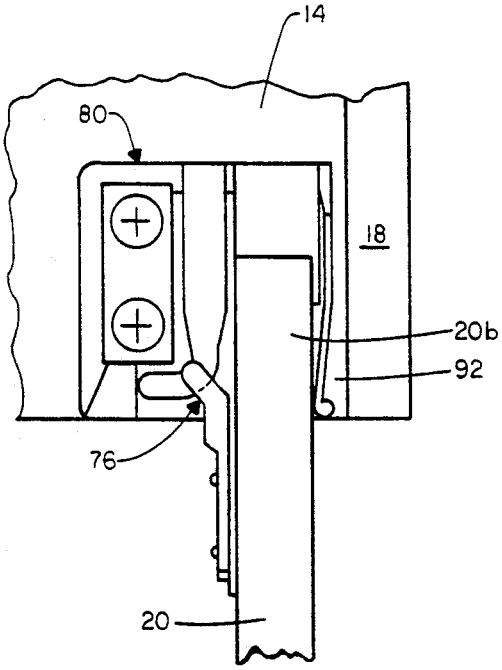
FIG. 17A is a fragmentary plan view showing the pocketing door and the lower guide bracket according to the invention of FIGS. 1 to 17, with the pocketing door in the open and partially pocketed position.
Figure 17B:
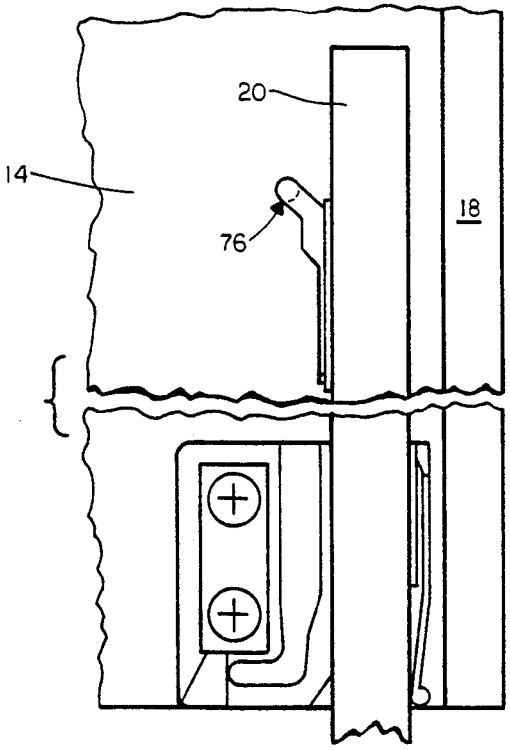
FIG. 17B is a fragmentary plan view showing the pocketing door and the lower guide bracket according to the invention of FIGS. 1–17A, with the pocketing door in the open and fully pocketed position.
Figure 17C:
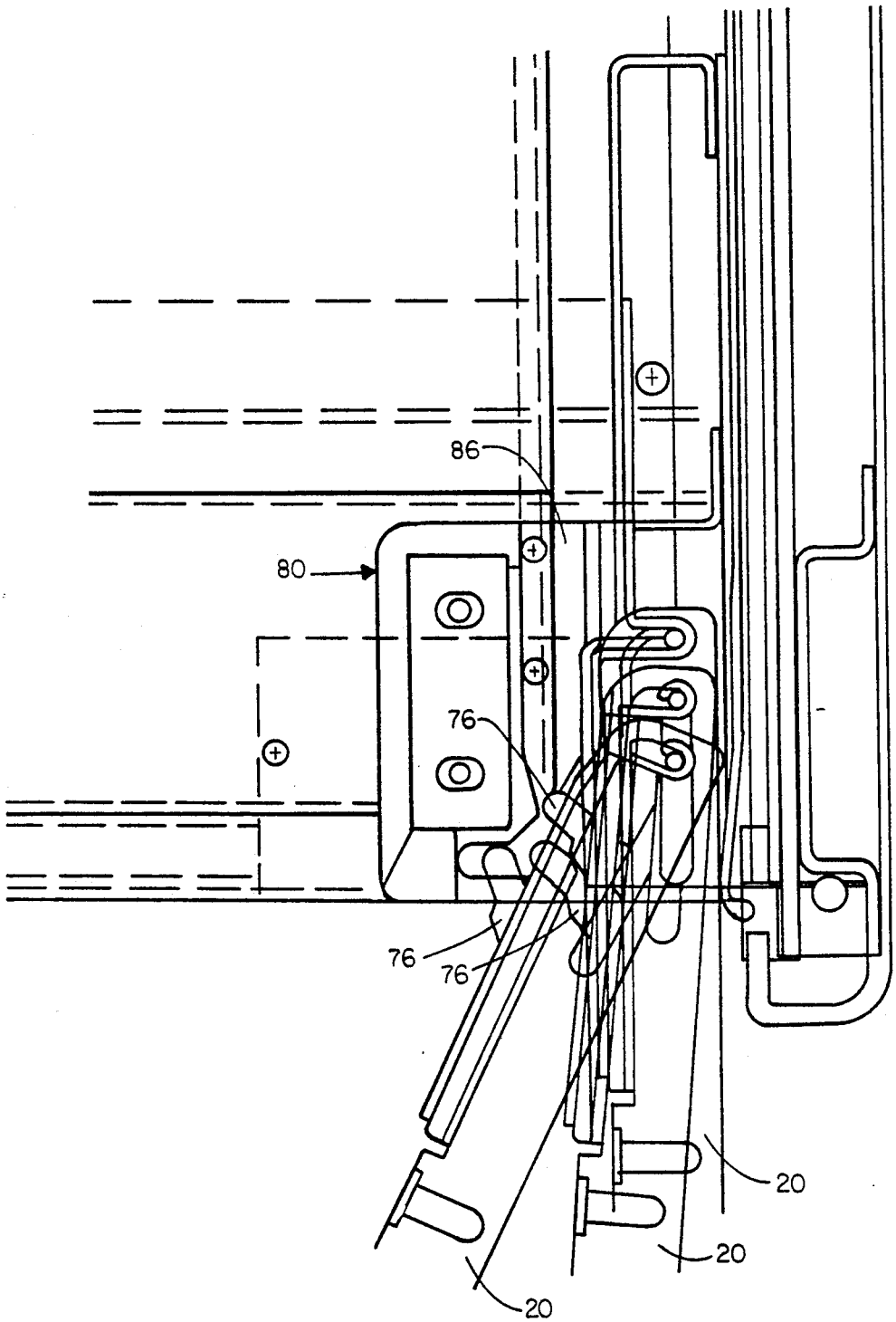
FIG. 17C is a plan view showing schematically the second embodiment of the lower guide bracket of FIG. 16C and the layout of the door in several positions as the door is moved between the open and partially pocketed position and the open and fully pocketed position.

A second embodiment of the lower guide bracket 80 is shown in FIGS. 16C and 17C. The second embodiment is substantially similar to the first embodiment differing only in its provision of a chamfered corner 86*e* intermediate the track walls 86*b* and 86*c*.

The upper guide bracket 78 is a molded plastic component having a flat base 96 and a pair of parallel, spaced apart depending flanges 98 which provide a channel 100 therebetween. The upper guide bracket 78 is mounted to the underside of the cabinet top wall 12 or an analogous element of the cabinet frame adjacent a forward corner 12*a* formed generally by the cabinet topwall 12 and side wall 18, as shown in FIG. 2. The upper guide bracket 78 is mounted to the cabinet using conventional hardware.

When the door is in the closed position, as shown in FIG. 17, the guide stud 84 is located at a distal end 102 of the short leg 104 of the L-shaped track 86. As each door 20 is swung to the open and partially pocketed position, the door is forced approximately 2"–3" into the cabinet to partially pocket the door. See FIG. 17A.

More specifically, as each door is moved from the closed to the open and partially pocketed position, the door horizontally rotates 90° about an axis or pivot point of the distal end 90 of the guide stud 84. Simultaneously, the guide stud 84 and the door 20 slide laterally within the short leg 102 of the L-shaped track 86 in a direction away from the distal end 104 of the short leg 102 and toward the cabinet side wall 18. At the conclusion of the open swing, the guide stud 84 is located approximately at a proximal end 93*b* of the short leg 104 of the L-shaped track 86. Thus, a dynamic pivot point of the door relative to the cabinet, the position of which is continuously changing as the door is opened, is provided.

As the door is simultaneously sliding and rotating, a portion 20*b* of the door 20, which portion extends between the outside corner 20*a* to that area of the door to which the flat mounting portion 82 of the guide 76 is secured, is captured within the channels 94 and 100 of the lower and upper guide brackets 80, 78. As the door swings through 90° from the closed to the open and partially pocketed position, the outside corner 20*a* of the door bears against the camming surface 92*d* of the spring arm 92. The resilient portion 92*b* of the spring arm 92 is displaced sufficiently to allow the door 20 to enter the channel 94 of the lower guide bracket 80. The natural tension of the resilient portion 92*b* of the spring arm 92 maintains the spring arm 92 against the door 20 to prevent lateral or rattling motion of the door when the door is subsequently moved between the partially and fully pocketed positions. Thus a smoothly operating, easily functioning pocketing door is provided.

In the open and partially pocketed position, the door is captured within the channels 94 and 100 of the lower and upper guide brackets 80, 78. Further, the door is aligned with the vertical carrier bar 28 and the adjacent cabinet side wall 18 and is positioned to be moved between the partially and fully pocketed positions. A user may move the door from the partially pocketed position to the fully pocketed position by the application of a rearwardly directed force to the door, which causes the door and the carrier bar to which it is mounted, to slidably move along the upper and lower guide frames 22*a*, 22*b* toward the rear ends of the same, thus fully pocketing the door. As the door is moved to the fully pocketed position as shown in FIG. 17B, the guide stud 84 exits the distal end 106 of the long leg 93 of the L-shaped track 86 which is open. The reverse of the above described sequence occurs when a door is moved from the fully pocketed position to the open and partially pocketed position, and then moved to the closed position.

With particular reference to the embodiment shown in FIGS. 11 to 15, the rearward movement of the door 20 into the open interior of the framework and toward the fully pocketed position is limited by the engagement of the carrier bar edge 236 with the bosses 274 of the door stops 270. Preferably, the stops 270 are positioned such that the front vertical edge of the door 20 is aligned with the front of the cabinet framework when the door is in the fully pocketed position. Thus, as the width of the door 20 increases, the door stops 270 should be secured at a location closer to the ends 250, 260 of, respectively, the upper and lower guide frames 200, 202.

The operation of the door can be more easily understood when it is realized that in order to partially pocket a door on the open swing, the guide stud, or pivot point for the door relative to the cabinet must be offset from the edge of the door. However, such an arrangement will cause the door, after being opened, to be partially pocketed at a distance quite removed from the cabinet side wall. Obviously, this is undesirable as it creates a void of generally unusable space between the door and the adjacent cabinet side wall. To maximize the volume of usable space within the cabinet interior, it is desirable to have the door partially pocketed closely adjacent to the cabinet side wall. Thus, in order for the door to be pocketed in a position different from that provided by the pivot point offset from the door edge, a dynamic pivot that simultaneously allows the door to rotate and laterally slide from its initial position to its subsequent and desired position closely adjacent to the cabinet side wall must be provided. Further, if the door is to be fully pocketed, it must be hingeably connected at its edge, or at a point closer to the edge of the door than the pivot point, to a vertical carrier bar that is mounted for sliding movement relative to the cabinet.

The guide 76, offset from the corner of the door 20*a*, in combination with the short leg 104 of the L-shaped track 86 in the lower guide bracket 80 provide means for partially pocketing the door 20 when it is moved through a 90° arc from the closed position. Thus the door and its hinges are protected from damage. If, while in the open position but before the doors have been fully pocketed, the doors should be accidentally impacted, for example, by a person stumbling against them, a portion of the door including the edge to which the hinges are mounted as well as the hinges themselves are already positioned within the cabinet. Thus, the impact is absorbed by the door and the cabinet frame rather than the hinges, which could yield and separate from the cabinet under the force.

The channel 100 of the upper guide bracket 78 in combination with the channel 94 and the spring arm 92 of the lower guide bracket 80 provide means for aligning the pocket door 20 parallel to the cabinet side wall 18 in preparation for subsequent pocketing. Similarly, the alignment means maintains each door in a parallel relation to the cabinet side wall as the door is moved to a fully pocketed position. A portion of the door is always captured within the channels 94, 100 of the upper and lower guide brackets 78, 80, thus facilitating easy operation of the doors. Further, the transition region 93*a* functions to properly align the door for movement into the short leg 104 of the track 86 when the door 20 is moved to the closed position from the partially pocketed position. The transition region 93*a* channels the door 20 into the short leg 104.

Similarly, the chamfered corner 86*e* in the second embodiment of the lower guide bracket 80 shown in FIGS. 16C and 17C facilitates the movement of the guide 76 between the short leg 104 and the long leg 93 of the L-shaped track by providing a beveled surface along which the guide stud 84 can slide.

The alignment means further performs a protective function. As each door is moved from the closed to the open and partially pocketed position, the track wall 86*a* provides an internal stop against further lateral movement of the door 20. The track wall 86*a* restrains the movement of the guide 76 such that it moves only within the track 94. Thus, the door can not be slid laterally beyond the travel allowed by the track 86. Limiting the lateral movement of the door protects the door and the hinges from the damage that could result if one attempted to force the doors closer to the cabinet side wall 18.

Further, the wall 86*a* of the lower guide bracket 80 provides means for indicating the position of the door 20. The internal stop provided by the wall 86*a* and described above also indicates that the door has reached the extent of the open swing and is properly positioned for rearward sliding movement into the cabinet to fully pocket the door. That is, the contact of the guide stud 84 with the track wall 86*a* provides a noticeable indication to a user that the door should not be further slid laterally and that the user should apply a rearwardly directed force to fully pocket the door. Similarly, as each door is moved from the fully pocketed position to the open and partially pocketed position, the guide stud 84 enters the transition region 93*a* of the track 86. The transition region 93*a* smoothly channels the guide stud 84 into the short leg 104 of the track 86 for subsequent closing movement. Also, the transition region 93*a* functions to slightly but noticeably retard the movement of the door, a change which is detectable by the user and which indicates that the door is properly positioned for movement to the fully closed position.

To facilitate manual operation of the doors between the closed, open and partially pocketed, and the open and fully pocketed positions, the doors are provided with handles 108 rotatably mounted to the doors 20 in such manner that the handle orientation can be maintained in a direction toward the worker operating the doors.

Figure 18:
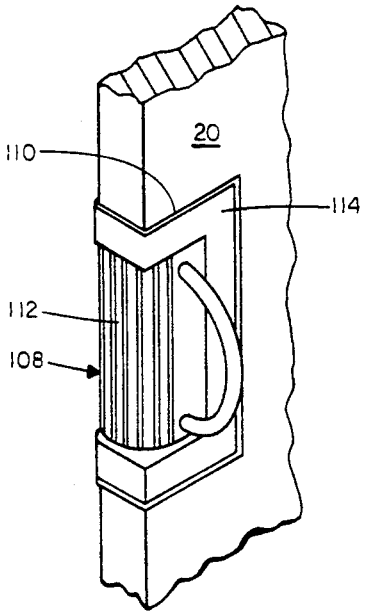
FIG. 18 is an enlarged perspective view of a door handle according to the invention.

Referring to FIGS. 1 and 18, on each side of the cabinet, the handle 108 is rotatably mounted to an inner edge of the door 20 by way of a cutout 110 in the door. Each door handle comprises a door pull 112 and a bezel 114 which is secured to the door in registry with the cutout.

Figure 20:
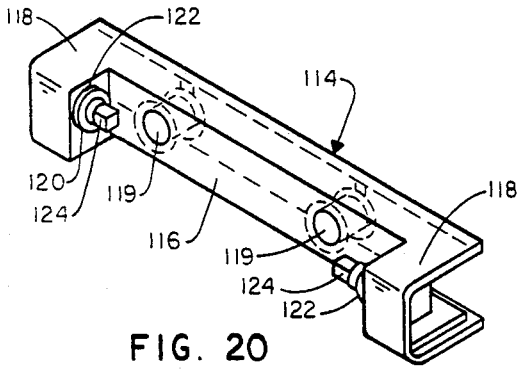
FIG. 20 is a perspective view of a bezel of the handle of FIGS. 18 and 19 according to the invention.

As illustrated in FIG. 20, the bezel 114 is a substantially square U-shaped molded plastic member having a web 116 intermediate to and integral with a pair of parallel spaced apart legs 118. The bezel 114 is placed in registry with the door cut-out 110 and secured to the door with a pair of screws (not shown) which are received by apertures 119 formed in the bezel's web. A pair of pins 120, formed integral with inside faces of the legs 118, extend parallel to the web 116 and are disposed in facing relationship. Each pin 120 comprises a circular base 122. Extending outwardly from each base is an elongated square projection 124.

Figure 21:
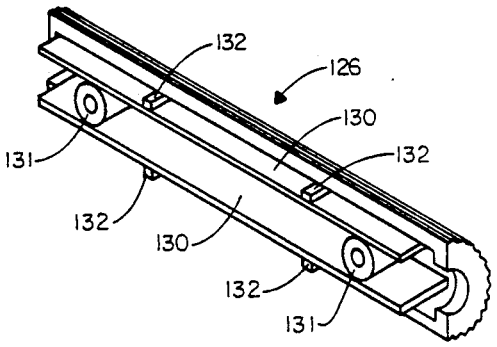
FIG. 21 a perspective view of a front half of the door pull of the handle of FIGS. 18 to 20 according to the invention.

The door pull 112 comprises complementary shaped front and back hollow halves 126 and 128, and a pair of leaf springs 130. As illustrated in FIG. 21, the front half 126 of the door pull 112 is an elongated injection molded plastic component open at each end and having a semi-circular shape in cross-section. A pair of inwardly directed parallel hollow cylindrical posts 131 are formed on an inside surface of the door pull's front half. Also projecting from the inside surface of the front half of the door pull intermediate the posts are two pairs of oppositely disposed flanges 132.

Figure 19:
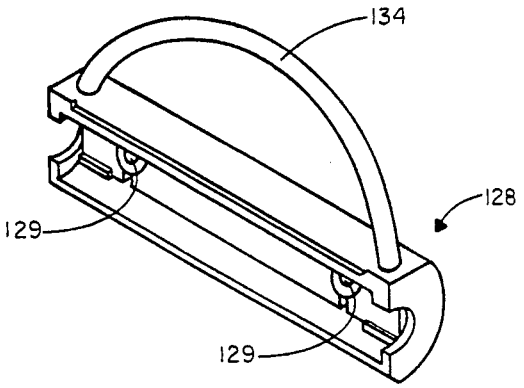
FIG. 19 is a perspective view of a back half of a door pull of the handle of FIG. 18 according to the invention.

As shown in FIG. 19, the back half 128 of the door pull 112 is an elongated injection molded plastic component open at each end. The back half of the door pull has a substantially semi-circular shape in cross-section and is provided with a pair of apertures 129 formed along approximately the axial center line of the door pull half. Opposite ends of a bail handle 134 are mounted to the back half 128 of the door pull 112 on a longitudinal side of the back half.

Each leaf spring 130 comprises an elongated rectangular section of resilient metal.

In assembly, the two leaf springs 130 are mounted on the door pull front half 126 in a parallel spaced relation by positioning the springs on opposite sides of the cylindrical posts 131 such that a longitudinal edge of each leaf spring is parallel to the front half longitudinal edges. Each leaf spring 130 bears against one of the two pair of oppositely disposed flanges 132. In this manner, the springs 130 are held between the respective flanges 132 and posts in parallel spaced apart relationship, such spacing being slightly greater than the cross-sectional geometric dimension of the square portions 124 of the pins.

The front door pull half 126 is mounted to the bezel 114. The semi-circular openings at each end receive the circular portion 122 of the bezel pins 120 and complementary ends of the leaf springs receive and engage opposite faces of the square portions 124 of the bezel pins.

The back half 128 of the door pull is mounted to the bezel pins 120 such that the open semi-circular ends receive the circular portion 122 of the pins. The back half of the pull is secured to the front half of the pull by screws that register with the apertures 129 in the back half of the door pull and the hollow cylindrical posts 131 in the front half of the door pull.

The engagement of the tensioned leaf springs 130 with the square portions 124 of the bezel pins 120 provides decent means for rotating the door pull relative to the bezel 114 to achieve any one of a number of adjusted positions. In operation, as a user grasps the bail 134 and pulls, the door pull 112 rotates about the bezel pins 120 until the center line of the bail is aligned with the direction of the applied force. The ends of the leaf springs rotate about the square portions 124 of the bezel pins 120 to move to positions of engagement with opposite corners of the square portions 124. From this orientation, a relatively small force is required to continue the rotation of the spring ends until they engage the adjacent faces of the bezel pins' square portions. Thus the door handles are rotatable through 180° with detent stop positions at the 0°, 90°, and 180° relative orientations.

Figure 22:
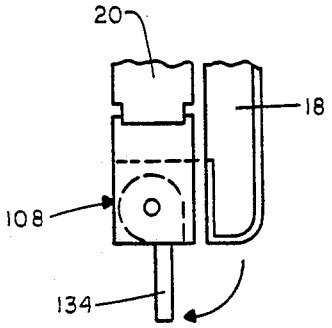
FIG. 22 is a fragmentary plan view showing schematically the operation of the handle of FIGS. 18 to 21 according to the invention, with a bail of the handle coplanar with the pocketing door.
Figure 23:
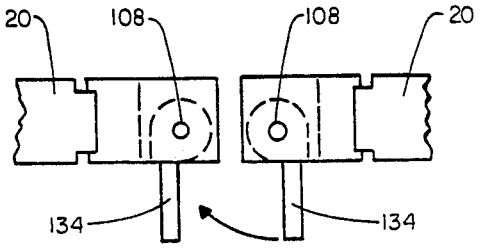
FIG. 23 is a fragmentary plan view showing schematically the operation of the door handle of FIGS. 18 to 22 according to the invention, with the bail of the handle normal to the pocketing doors.

As illustrated in FIGS. 18, 22 and 23, when the doors are in the closed position, the handle is positioned so that the bail 134 is normal to the plane of the door 20. As the door is moved to the open position, the handle is rotated so that the bail 134 is positioned coplanar with the door. The door can then be fully pocketed into the cabinet as well as easily withdrawn from the same. In this manner, a worker can grasp the bail of the handle to open the door and pocket the same while maintaining the orientation of the bail toward himself/herself for convenient operation of the door.

It will be appreciated that the instant specification and claims are set forth by way of illustration and not limitation, and that reasonable variations and modifications are possible without departing from the spirit and scope of the invention.

The embodiments for which an exclusive property or privilege is claimed are defined as follows:

1. A cabinet comprising a plurality of walls including at least one side wall, the walls being joined together to provide a cabinet framework having an open front and an open interior;

a door of a size to at least partially cover the open front;

an upper guide frame and a lower guide frame, each mounted to the cabinet framework adjacent to the at least open side wall;

a carrier having an upper end and a lower end;

a hinge pivotally mounting the door to the carrier;

means for mounting the upper and lower ends of the carrier to, respectively, the upper and lower guide frames;

the carrier mounting means comprising a pair of upper wheels and a pair of lower wheels, said upper wheels being mounted adjacent to the upper end of the carrier for rolling engagement with the upper guide frame, and said lower wheels being mounted adjacent to the lower end of the carrier for rolling engagement with the lower guide frame; and a cable having first and second ends each fixed relative to the cabinet framework and a portion intermediate the first and second ends passing over one of the upper wheels and one of the lower wheels;

whereby the door is adapted to move between a closed position in which the door at least partially covers the open front and a pocketed position in which the door is received within the open interior of the framework and adjacent to the at least one side wall, the carrier and the door reciprocate along the upper and lower guide frames as the door is moved between the open and pocketed positions, and the door will be restrained by the cable from skewing or sagging out of a predetermined relationship to the upper and lower guide frames.

2. A cabinet according to claim 1, wherein the upper guide frame includes an upper edge and a lower edge opposite the upper edge, and further wherein one of said pair of upper wheels rolls on the upper edge and the other of said pair rolls on the lower edge.

3. A cabinet according to claim 2, wherein said one of said upper pair of wheels is load bearing.

4. A cabinet according to claim 3, wherein the lower guide frame includes an upper edge and a lower edge opposite the upper edge and further wherein one of said pair of lower wheels rolls on the upper edge and the other of said pair rolls on the lower edge.

5. A cabinet according to claim 4, wherein said other of said lower pair of wheels is load bearing.

6. A cabinet according to claim 1, wherein the upper guide frame has a web intermediate an elongated upper rail and a lower rail opposite the upper rail, the rails being integral with the web and extending outwardly therefrom, and further wherein one of said pair of upper wheels rolls on the upper rail and the other of said pair rolls on the lower rail.

7. A cabinet according to claim 6, wherein said one of said upper pair of wheels is load bearing.

8. A cabinet according to claim 7, wherein the lower guide frame has a web intermediate an upper rail and an elongated lower rail opposite the upper rail, the rails being integral with the web and extending outwardly therefrom, and further wherein one of said pair of lower wheels rolls on the upper rail and the other of said pair rolls on the lower rail.

9. A cabinet according to claim 8, wherein said other of said lower pair of wheels is load bearing.

10. A cabinet according to claim 1, wherein each wheel includes an outer sleeve rotatably mounted to an inner sleeve.

11. A cabinet according to claim 10, wherein the outer sleeve of at least two of the wheels includes a portion defining a first circumferential channel and a portion defining a second circumferential channel adjacent to the first channel.

12. A cabinet according to claim 11, wherein the upper guide frame includes an upper edge and a lower edge opposite the upper edge, the upper edge being received in the first circumferential channel of said pair of upper wheels for rolling of one of said pair of upper wheels on the upper edge, the lower edge being received in the first circumferential channel of the other of said pair for rolling of said other wheel on the lower edge.

13. A cabinet according to claim 12, wherein said one wheel of said upper pair of wheels is load bearing.

14. A cabinet according to claim 13, wherein the lower guide frame includes an upper edge and a lower edge opposite the upper edge, the upper edge being received in the first circumferential channel of one of said pair of lower wheels for rolling of said one wheel on the upper edge, the lower edge being received in the first circumferential channel of the other of said pair for rolling of said other wheel on the lower edge.

15. A cabinet according to claim 14, wherein said other wheel of said lower pair of wheels is load bearing.

16. A cabinet according to claim 1, wherein the cable is wound around one of the upper pair of wheels and wound around one of the lower pair of wheels.

17. A cabinet according to claim 16, wherein the cable is fixed to the upper and lower guide frames.

18. A cabinet according to claim 1 wherein each wheel around which the cable passes includes a pair of tracks, and the cable passes over each wheel twice and is received in each track of each wheel.

19. A cabinet according to claim 18, wherein the cable is wound around one of the upper pair of wheels and wound around one of the lower pair of wheels.

20. A cabinet according to claim 19, wherein the cable is fixed to the upper and lower guide frames.

21. A cabinet according to claim 20, wherein the cable is under tension and the stabilizing means further includes a spring for tensioning the cable.

22. A cabinet according to claim 21, wherein the stabilizing means further includes a cable tie down assembly for selectively and releasably retaining the cable at a desired tension.

23. A cabinet according to claim 22, wherein the cable tie down assembly includes means for clamping the cable to the guide frames.

24. A cabinet according to claim 23, wherein the cable is clamped adjacent to the spring.

25. A cabinet according to claim 21, wherein the stabilizing means includes a pair of springs for tensioning the cable.

26. A cabinet according to claim 25, wherein each spring secured to the cable and to one of the guide frames.

27. A cabinet according to claim 26, wherein one spring is secured to the upper guide frame and the other spring is secured to the lower guide frame.

28. A cabinet according to claim 27, wherein the stabilizing means further includes a cable tie down assembly for selectively and releasably retaining the cable at a desired tension.

29. A cabinet according to claim 28, wherein the cable tie down assembly includes means for clamping the cable to the guide frames.

30. A cabinet according to claim 29, wherein the cable is clamped to the upper and lower guide frames adjacent to the respective springs.

31. A cabinet according to claim 17, wherein the upper guide frame includes an upper edge and a lower edge opposite the upper edge, and further wherein one of said pair of upper wheels rolls on the upper edge and the other of said pair rolls on the lower edge.

32. A cabinet according to claim 31, wherein said one of said upper pair of wheels is load bearing.

33. A cabinet according to claim 32, wherein the lower guide frame includes an upper edge and a lower edge opposite the upper edge, and further wherein one of said pair of lower wheels rolls on the upper edge and the other of said pair rolls on the lower edge.

34. A cabinet according to claim 33 wherein said other of said lower pair of wheels is load bearing.

35. A cabinet according to claim 17, wherein the upper guide frame has a web intermediate an elongated upper rail and a lower rail opposite the upper rail, the rails being integral with the web and extending outwardly therefrom, and further wherein one of said pair of upper wheels rolls on the upper rail and the other of said pair rolls on the lower rail.

36. A cabinet according to claim 35, wherein said one of said upper pair of wheels is load bearing.

37. A cabinet according to claim 36 wherein the lower guide frame has a web intermediate an upper rail and a elongated lower rail opposite the upper rail, the rails being integral with the web and extending outwardly therefrom, and further wherein one of said pair of lower wheels rolls on the upper rail and the other of said pair rolls on the lower rail.

38. A cabinet according to claim 37, wherein said other of said lower pair of wheels is load bearing.

39. A cabinet according to claim 1, further comprising a handle rotatably mounted to the door for movement between an orientation perpendicular to the face of the door for gripping when the door is in the closed position and an orientation parallel to the face of the door and projecting from the second edge of the door when the door is in the pocketed position.

40. A cabinet according to claim 39, wherein the second edge of the door includes a recess, the handle being received within the recess.

41. A cabinet according to claim 39, wherein as the door is moved between the closed and pocketed positions the handle rotates to an orientation that is aligned with the direction in which the force to move the door is applied.

42. A cabinet according to claim 41, wherein the handle includes a spring for selectively retaining the handle in the desired orientation.

43. A cabinet according to claim 42, wherein the handle further includes a pair of pins, each pin having an equal number of faces, and the spring engages a first face of each pin when the handle is in a first orientation.

44. A cabinet according to claim 43, wherein the spring rotates as the handle is rotated to a second orientation displaced from the first orientation, whereby the spring engages a second face of each pin when the handle is in the second orientation.

45. A cabinet according to claim 44, wherein each pin has hour faces.

46. A cabinet according to claim 45, wherein each pin is substantially square in cross section, the handle includes a pair of springs, and each spring engages one of the pin faces, the faces engaged by each pin being opposed.

47. A cabinet according to claim 1 further comprising means for limiting movement of the door into the open interior of the framework.

48. A cabinet according to claim 47, wherein the door movement limiting means includes a door stop and means for mounting the stop to one of said upper and lower guide frames.

49. A cabinet according to claim 48, wherein the carrier includes an edge and engagement of the carrier edge with the door stop limits movement of the door into the framework interior.

50. A cabinet according to claim 49, the door movement limiting means further including a second door stop mounted to the other of said upper and lower guide frames.

* * * * *

UNITED STATES PATENT AND TRADEMARK OFFICE

CERTIFICATE OF CORRECTION

PATENT NO. : 5,078,461

DATED : January 7, 1992

INVENTOR(S) : Beck et al.

It is certified that error appears in the above-identified patent and that said Letters Patent is hereby corrected as shown below:

Claim 1, column 18, line 25, "at least open side" should read --at least one side--.

Signed and Sealed this

Thirteenth Day of April, 1993

*Attest:*

STEPHEN G. KUNIN

*Attesting Officer*

*Acting Commissioner of Patents and Trademarks*